US011392075B2

(12) United States Patent
Ishizumi et al.

(10) Patent No.: US 11,392,075 B2
(45) Date of Patent: Jul. 19, 2022

(54) IMAGE-FORMING APPARATUS WHICH CONTROLS THE ROTATION OF THE INTERMEDIATE TRANSFER BELT BASED ON ACCUMULATED TONER

(71) Applicant: CANON KABUSHIKI KAISHA, Tokyo (JP)

(72) Inventors: Keisuke Ishizumi, Kanagawa (JP); Shohei Ishio, Tokyo (JP); Shinji Katagiri, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/325,064

(22) Filed: May 19, 2021

(65) Prior Publication Data

US 2021/0373482 A1 Dec. 2, 2021

(30) Foreign Application Priority Data

May 26, 2020 (JP) ..... JP2020-091673

(51) Int. Cl.

| | |
|---|---|
| ***G03G 15/16*** | (2006.01) |
| ***G03G 21/00*** | (2006.01) |
| ***G03G 15/01*** | (2006.01) |
| ***G03G 15/02*** | (2006.01) |
| ***G03G 9/087*** | (2006.01) |

(52) U.S. Cl.

CPC ..... *G03G 21/0017* (2013.01); *G03G 9/08773* (2013.01); *G03G 15/0189* (2013.01); *G03G 15/0258* (2013.01); *G03G 15/162* (2013.01); *G03G 2215/1661* (2013.01)

(58) Field of Classification Search

CPC ..... G03G 15/161; G03G 21/0011; G03G 2215/1661

USPC ..... 399/71, 101

See application file for complete search history.

(56) References Cited

U.S. PATENT DOCUMENTS

| | | | | |
|---|---|---|---|---|
| 11,209,767 | B2 * | 12/2021 | Ishio et al. ..... | G03G 21/0017 |
| 2021/0302900 | A1 * | 9/2021 | Ishio et al. ..... | G03G 21/0011 |

FOREIGN PATENT DOCUMENTS

| | | | |
|---|---|---|---|
| JP | 2012233994 | A | 11/2012 |
| JP | 2014182308 | A | 9/2014 |
| JP | 2015125187 | A | 7/2015 |
| JP | 2019045583 | A | 3/2019 |

* cited by examiner

*Primary Examiner* — William J Royer

(74) *Attorney, Agent, or Firm* — Canon U.S.A., Inc. I.P. Division

(57) ABSTRACT

Toner contains toner base particles and an organosilicon polymer on the surface of the toner base particles. After a toner image is transferred from an intermediate transfer belt to a transfer material, residual toner on the intermediate transfer belt is collected into a belt cleaning device by a blade. A CPU executes supply control of supplying toner from a developing device toward the blade via a photosensitive drum and via the intermediate transfer belt on the basis of a counter accumulated value that correlates with an amount of organosilicon polymer adhering to the blade.

20 Claims, 16 Drawing Sheets

IMAGE-FORMING APPARATUS WHICH CONTROLS THE ROTATION OF THE INTERMEDIATE TRANSFER BELT BASED ON ACCUMULATED TONER

BACKGROUND

Field of the Disclosure

The present disclosure generally relates to an electrophotographic image-forming apparatus, such as a laser printer, a copying machine, or a facsimile machine.

Description of the Related Art

In an electrophotographic color-image-forming apparatus, an intermediate transfer system has been known in which a toner image is successively transferred from an image-forming portion of each color to an intermediate transfer member, and the toner images are entirely transferred from the intermediate transfer member to a transfer material.

In such an image-forming apparatus, the image-forming portion of each color has a drum-shaped photosensitive member (hereinafter referred to as a photosensitive drum) as an image-bearing member. The intermediate transfer member is typically an intermediate transfer belt formed of an endless belt. A toner image formed on the photosensitive drum of each image-forming portion is primarily transferred to an intermediate transfer belt by applying a voltage from a primary transfer power supply to a primary transfer member facing the photosensitive drum with the intermediate transfer belt interposed therebetween. The color toner images primarily transferred from the image-forming portion of each color to the intermediate transfer belt are entirely secondarily transferred from the intermediate transfer belt to a transfer material, such as a paper or OHP sheet, by applying a voltage from a secondary transfer power supply to a secondary transfer member in a secondary transfer portion. The color toner images transferred to the transfer material are then fixed to the transfer material by fixing means.

In an image-forming apparatus of the intermediate transfer system, toner remains on an intermediate transfer belt (untransferred toner) after toner images are secondarily transferred from the intermediate transfer belt to a transfer material. Thus, the untransferred toner remaining on the intermediate transfer belt must be removed before a toner image corresponding to another image is primarily transferred to the intermediate transfer belt.

Untransferred toner is typically removed by a blade cleaning system. In the blade cleaning system, untransferred toner is scraped off with a cleaning blade and is collected into a cleaner case. The cleaning blade is located downstream of the secondary transfer portion in the movement direction of the intermediate transfer belt and abuts as a contact member against the intermediate transfer belt. The cleaning blade is typically made of an elastomer, such as a urethane rubber. The cleaning blade is often arranged such that an edge of the cleaning blade is pressed against the intermediate transfer belt in a direction (counter direction) opposite to the movement direction of the intermediate transfer belt.

Japanese Patent Laid-Open No. 2015-125187 discloses that grooves are formed on the surface of an intermediate transfer belt along the movement direction of the intermediate transfer belt to reduce the abrasion of a cleaning blade.

In such a structure, the contact area between the cleaning blade and the intermediate transfer belt is decreased to reduce the coefficient of friction between the cleaning blade and the intermediate transfer belt and to reduce the abrasion of the cleaning blade, thereby reducing the occurrence of faulty cleaning.

SUMMARY

Aspects of the present disclosure provides an image-forming apparatus that is less likely to cause faulty cleaning irrespective of the structure of an intermediate transfer member, in which residual toner on the intermediate transfer member is collected with a contact member that abuts against the intermediate transfer member.

According to a first aspect of the disclosure, an image-forming apparatus includes an image-bearing member configured to bear a toner image, a developing unit, which includes a storage portion configured to accommodate toner and a developing member configured to develop a latent image formed on the image-bearing member with the toner, a movable endless intermediate transfer member configured to be in contact with the image-bearing member, form a primary transfer portion, a transfer member configured to be in contact with the intermediate transfer member, form a secondary transfer portion, and transfer the toner image from the intermediate transfer member to a transfer material in the secondary transfer portion, a cleaning blade that is located downstream of the secondary transfer portion and upstream of the primary transfer portion in a movement direction of the intermediate transfer member, is in contact with the intermediate transfer member, and forms a contact portion, a collecting portion configured to collect residual toner on the intermediate transfer member with the cleaning blade after passing through the secondary transfer portion, and a control unit configured to control execution of a supply operation of supplying the toner from the developing unit to the contact portion via the image-bearing member and via the intermediate transfer member, wherein the toner accommodated in the developing unit contains toner base particles and an organosilicon polymer on a surface of the toner base particles, and the control unit controls the supply operation to be performed when an accumulated value that correlates with an amount of the organosilicon polymer adhering to the cleaning blade is less than a first threshold.

Further features of the present disclosure will become apparent from the following description of exemplary embodiments with reference to the attached drawings.

DESCRIPTION OF THE EMBODIMENTS

Exemplary embodiments of the present disclosure are described below with reference to the accompanying drawings. The dimensions, materials, shapes, and relative arrangement of the components described in these exemplary embodiments should be appropriately changed according to the configuration of the apparatus to which the present disclosure is applied and other conditions, and the scope of the present disclosure is not limited to these embodiments.

Exemplary Embodiment 1

[Image-Forming Apparatus]

Figure 1:
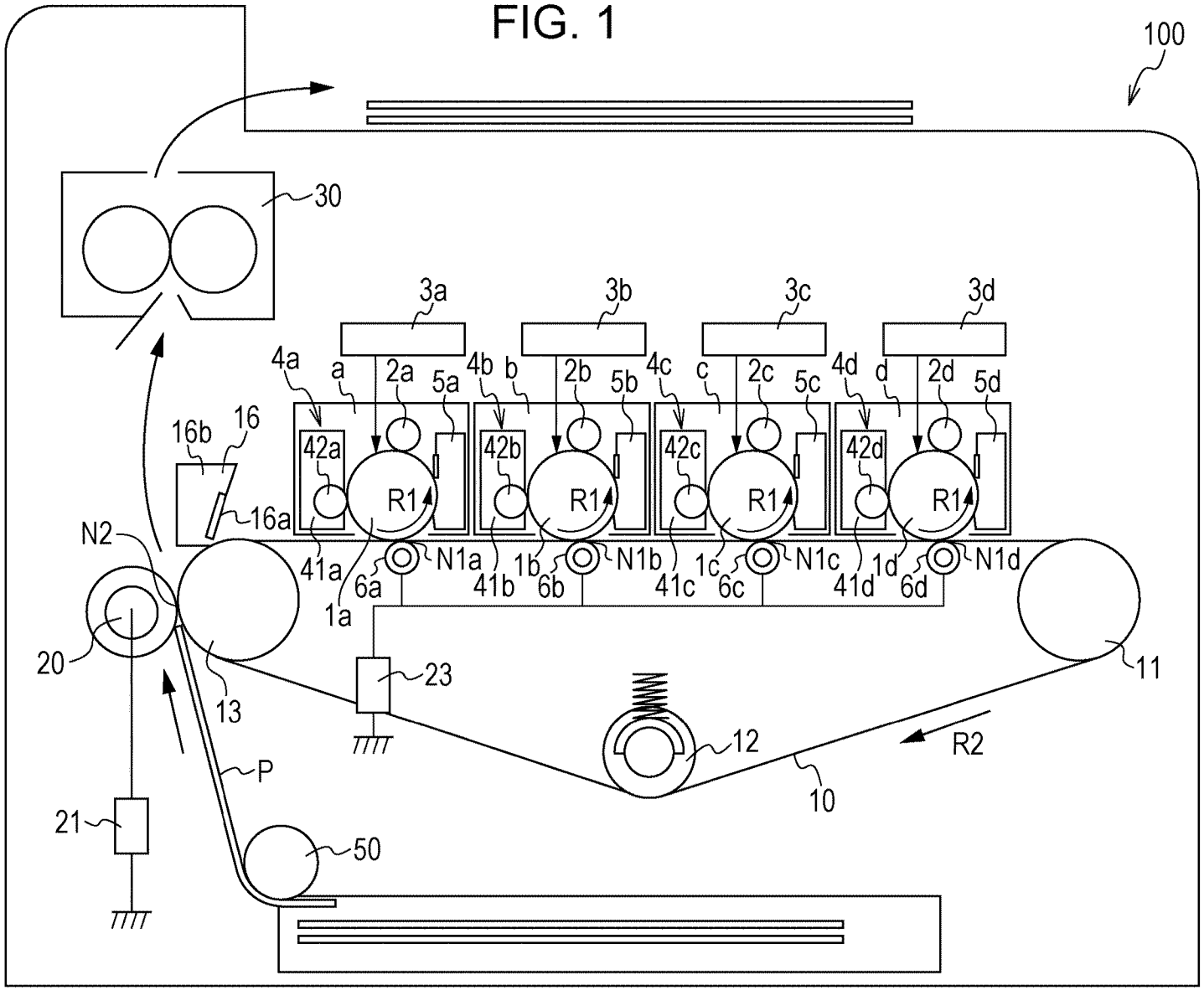
FIG. 1 is a schematic cross-sectional view of an image-forming apparatus according to exemplary embodiment 1.

FIG. 1 is a schematic cross-sectional view of an image-forming apparatus 100 according to the present exemplary embodiment. The image-forming apparatus 100 according to the present exemplary embodiment is a tandem type image-forming apparatus including a plurality of image-forming portions a to d. A first image-forming portion a forms an image with a yellow (Y) toner, a second image-forming portion b forms an image with a magenta (M) toner, a third image-forming portion c forms an image with a cyan (C) toner, and a fourth image-forming portion d forms an image with a black (Bk) toner. These four image-forming portions a to d are arranged in a row at regular intervals, and the configuration of each image-forming portion a to d is substantially the same except for the color of toner accommodated therein. Thus, the image-forming apparatus 100 according to the present exemplary embodiment is described below with respect to the first image-forming portion a.

The first image-forming portions a-d include a photosensitive drum 1 (1*a* to 1*d*), which is a drum-shaped photosensitive member, a charging roller 2 (2*a* to 2*d*), which is a charging member, an exposure device 3 (3*a* to 3*d*) a developing device 4 (4*a* to 4*d*), and a drum cleaning member (5*a* to 5*d*). The developing device 4 includes a developing container 41 (41*a* to 41*d*) (storage portion) configured to accommodate a toner, and a development roller 42 (42*a* to 42*d*), which is a developing member configured to bear the toner accommodated in the developing container 41 and to develop a toner image on the photosensitive drum 1. The toner image is transferred to the intermediate transfer belt 10 at the primary transfer portion N1 (N1*a* to N1*d*).

The photosensitive drum 1*a* is an image-bearing member configured to bear a toner image and is rotationally driven at a predetermined process speed (200 mm/s in the present exemplary embodiment) in the direction of the arrow R1 illustrated in the drawing. The developing device 4*a* includes a developing container 41*a* (storage portion) configured to accommodate a yellow toner, and a development roller 42*a*, which is a developing member configured to bear the yellow toner accommodated in the developing container 41*a* and to develop a yellow toner image on the photosensitive drum 1*a*. The drum cleaning member 5*a* is a member for collecting toner on the photosensitive drum 1*a*. The drum cleaning member 5*a* includes a cleaning blade, which comes into contact with the photosensitive drum 1*a*, and a waste toner box configured to accommodate toner removed from the photosensitive drum 1*a* by the cleaning blade.

When a formatter 273 serving as a control unit receives an image signal, a CPU 276 serving as a controller starts an image-forming operation, and the photosensitive drum 1*a* is rotationally driven. In the rotation process, the photosensitive drum 1*a* is uniformly charged to a predetermined electric potential (charging potential) with a predetermined polarity (negative polarity in the present exemplary embodiment) by the charging roller 2*a* and is exposed to light emitted from an exposure device 3*a* in accordance with an image signal. This forms an electrostatic latent image corresponding to a yellow component image of a target color image. The electrostatic latent image is then developed by the developing device 4*a* at the development position and is visualized as a yellow toner image (hereinafter referred to simply as a toner image). The normal charge polarity of the toner accommodated in the developing device 4*a* is negative polarity. In the present exemplary embodiment, the electrostatic latent image is reverse-developed with toner charged with the same polarity as the charge polarity of the photosensitive drum by the charging member. The present disclosure, however, can also be applied to an image-forming apparatus in which an electrostatic latent image is positively developed with toner charged with polarity opposite to the charge polarity of the photosensitive drum.

An intermediate transfer belt 10, which is an endless movable intermediate transfer member, abuts against photosensitive drums 1*a* to 1*d* of the image-forming portions a to d and is stretched by three shafts of a support roller 11, a stretching roller 12, and an opposed roller 13, which are stretching members. The intermediate transfer belt 10 is stretched at a tension of 60 N by the stretching roller 12 and is moved in the direction of the arrow R2 in the drawing as the opposed roller 13 is rotated by a driving force. The intermediate transfer belt 10 in the present exemplary embodiment is composed of a plurality of layers and is described in detail later.

While passing through a primary transfer portion N1*a* where the photosensitive drum 1*a* comes into contact with the intermediate transfer belt 10, a toner image formed on the photosensitive drum 1*a* is primarily transferred to the intermediate transfer belt 10 by applying a positive voltage from a primary transfer power supply 23 to a primary transfer roller 6*a*. Subsequently, residual toner on the photosensitive drum 1*a*, which is not primarily transferred to the intermediate transfer belt 10, is collected by the drum cleaning member 5*a* and is removed from the surface of the photosensitive drum 1*a*.

The primary transfer roller 6*a* is a primary transfer member (contact member) facing the photosensitive drum 1*a* via the intermediate transfer belt 10 and is in contact with the inner peripheral surface of the intermediate transfer belt 10. The primary transfer power supply 23 is a power supply that can apply a positive or negative voltage to primary transfer rollers 6*a* to 6*d*. In the present exemplary embodiment, a voltage is applied from the common primary transfer power supply 23 to the plurality of primary transfer members 6*a* to 6*d*. The present disclosure, however, is not limited to the present exemplary embodiment and can also be applied to a configuration in which a primary transfer power supply is provided for each primary transfer member.

In the same manner, a magenta toner image, a cyan toner image, and a black toner image are formed and are successively transferred to the intermediate transfer belt 10. Thus, four color toner images corresponding to the target color image are formed on the intermediate transfer belt 10. While passing through the secondary transfer portion in which a secondary transfer roller 20 comes into contact with the intermediate transfer belt 10, the four color toner images on the intermediate transfer belt 10 are entirely secondarily transferred to the surface of a transfer material P, such as a paper or OHP sheet, fed by a sheet feeder 50.

The secondary transfer roller 20 is a nickel-plated steel bar 8 mm in outer diameter covered with a foam sponge with a volume resistivity of $10^8$ Ω·cm and a thickness of 5 mm composed mainly of NBR and epichlorohydrin rubber and has an outer diameter of 18 mm. The foam sponge had a rubber hardness of 30° at a load of 500 g as measured with an Asker durometer type C. The secondary transfer roller 20 is in contact with the outer peripheral surface of the intermediate transfer belt 10, is pressed at a pressure of 50 N against the opposed roller 13 facing the secondary transfer roller 20 via the intermediate transfer belt 10, and constitutes a secondary transfer portion N2.

The secondary transfer roller 20 is driven to rotate with the intermediate transfer belt 10. When a voltage is applied by a secondary transfer power supply 21, an electric current flows from the secondary transfer roller 20 toward the opposed roller 13. Thus, the toner image on the intermediate transfer belt 10 is secondarily transferred to the transfer material P in the secondary transfer portion N2. When the toner image on the intermediate transfer belt 10 is secondarily transferred to the transfer material P, the voltage applied from the secondary transfer power supply 21 to the secondary transfer roller 20 is controlled such that a constant electric current flows from the secondary transfer roller 20 to the opposed roller 13 via the intermediate transfer belt 10. The electric current for the secondary transfer is determined in advance according to the environment surrounding the image-forming apparatus 100 and the type of the transfer material P. The secondary transfer power supply 21 is coupled to the secondary transfer roller 20 and applies a transfer voltage to the secondary transfer roller 20. The secondary transfer power supply 21 can output a voltage in the range of 100 to 4000 V.

The transfer material P to which the four color toner images have been transferred in the secondary transfer is then heated and pressed by a fixing device 30, and the four color toner images are melted, mixed, and fixed to the transfer material P. Residual toner on the intermediate transfer belt 10 after the secondary transfer is removed by cleaning with a belt cleaning device 16 (collecting device) located downstream of the secondary transfer portion N2 in the movement direction of the intermediate transfer belt 10. The belt cleaning device 16 includes a cleaning blade 16*a* serving as a contact member, which can abut against the outer peripheral surface of the intermediate transfer belt 10 at a position facing the opposed roller 13, and a waste-toner container 16*b* configured to accommodate toner collected by the cleaning blade 16*a*. In the following description, the cleaning blade 16*a* is simply referred to as the blade 16*a*.

The image-forming apparatus 100 according to the present exemplary embodiment forms a full-color print image through the above operation.

[Description of Control Block Diagram]

Figure 2:
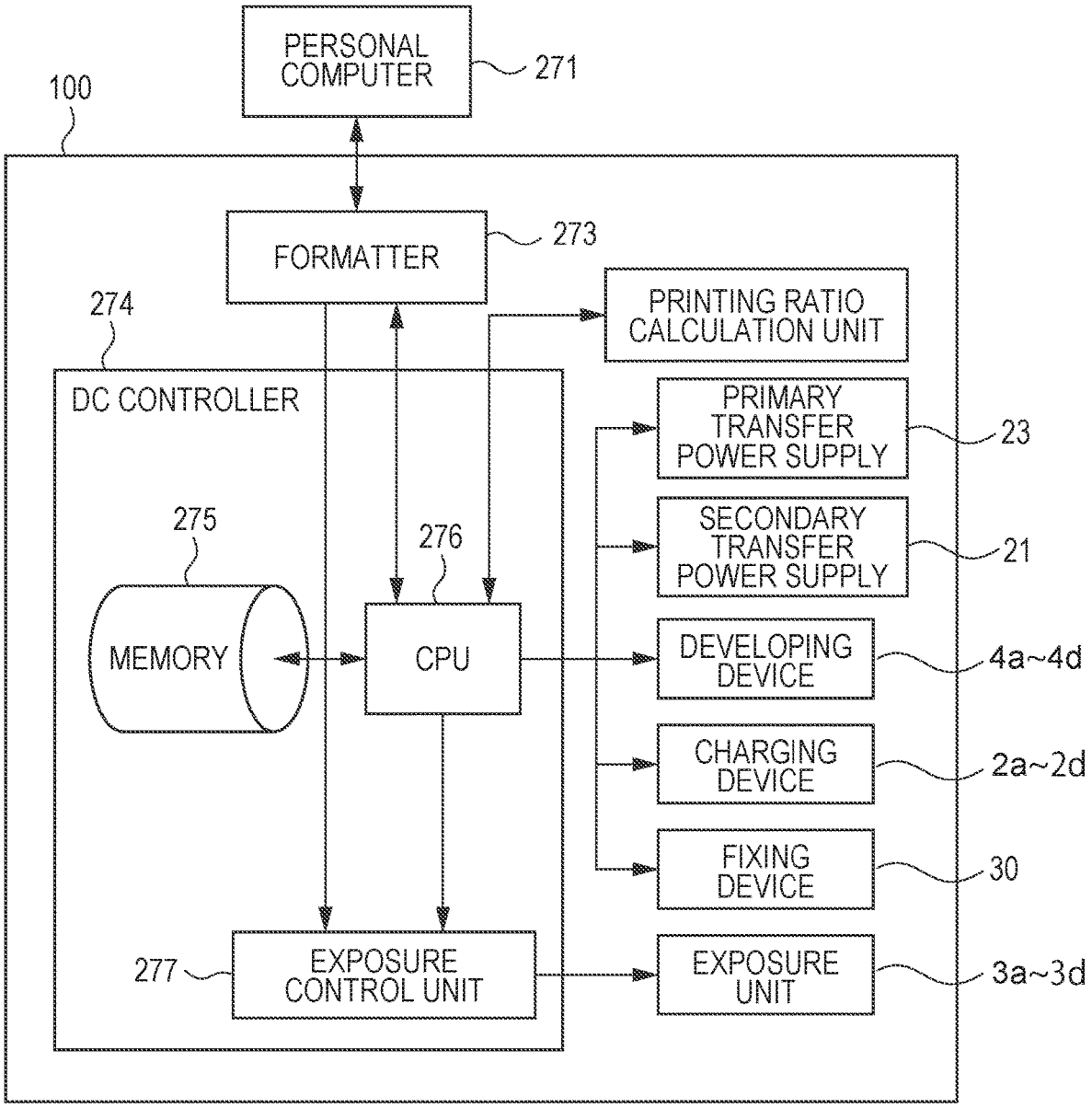
FIG. 2 is a block diagram illustrating the operation control of the image-forming apparatus according to the exemplary embodiment 1.

FIG. 2 is a control block diagram of controlling the operation of the image-forming apparatus 100. As illustrated in FIG. 2, a personal computer 271 serving as a host device sends a print command to the formatter 273 in the image-forming apparatus 100 and transmits image data of a print image to the formatter 273. The formatter 273 converts the image data transmitted from the personal computer 271 into exposure data and transmits the exposure data to an exposure control unit 277 in a DC controller 274. The exposure control unit 277 controls the on/off of the exposure data in accordance with an instruction from the CPU 276 (controller) and thereby controls exposure devices 3*a* to 3*d*. In the image-forming apparatus 100 in FIG. 2, the on-off area of the exposure data is adjusted to perform halftone control of an image.

The CPU 276 starts an image formation sequence upon receiving the print command from the formatter 273. The DC controller 274 includes the CPU 276 and a memory 275 and performs a pre-programmed operation. The CPU 276 controls a charging device, a developing device, a primary transfer power supply, a secondary transfer power supply, a fixing device, and the like and thereby controls the formation of an electrostatic latent image, transfer of a developed toner image to a transfer material, and fixation of the developed toner image to form an image. The CPU 276 can control a printing ratio calculation unit to calculate the printing ratio of each color on the basis of the image data and adjust various devices and the operation sequence in accordance with the calculated printing ratios.

Figure 3:
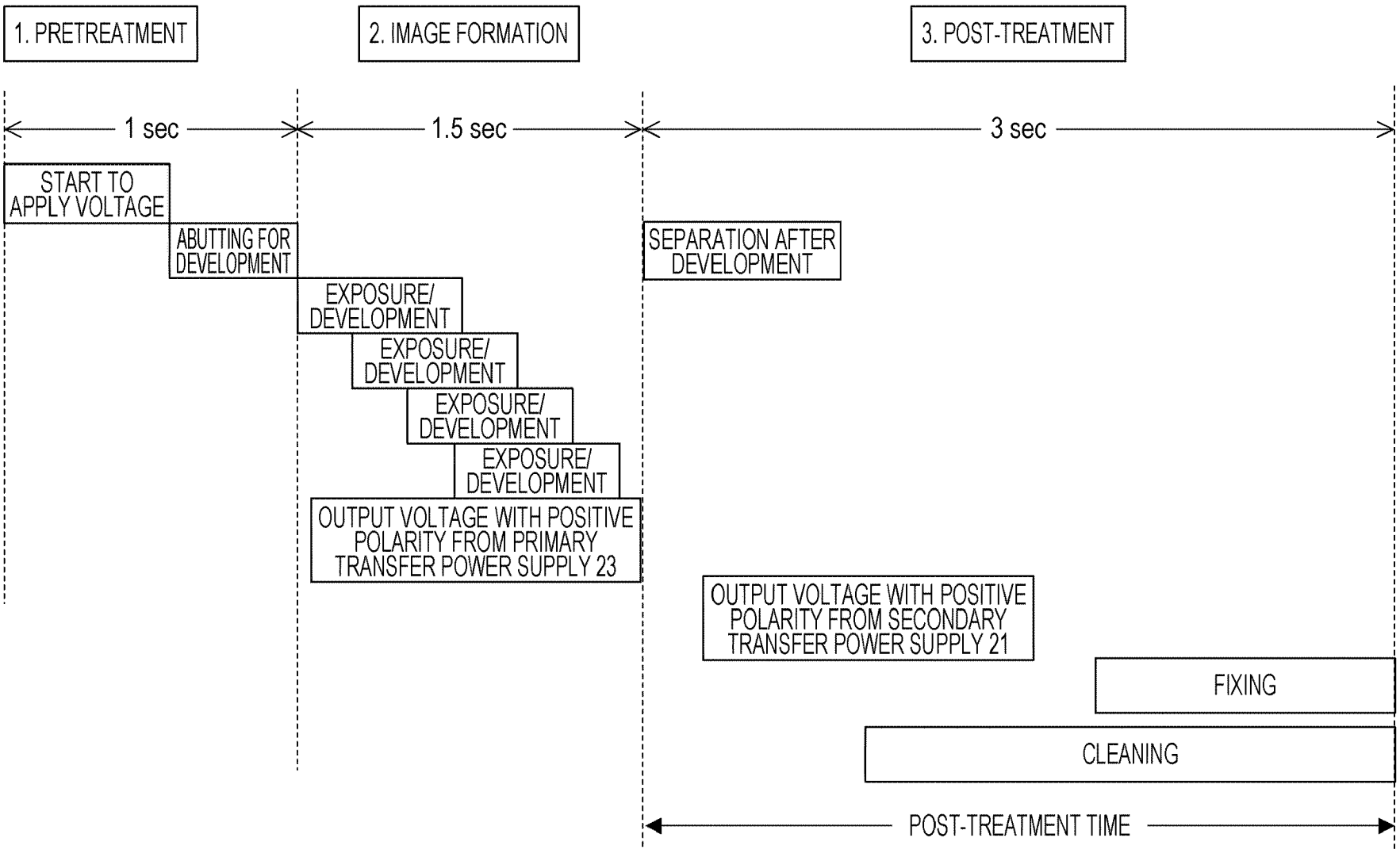
FIG. 3 is a timing chart illustrating an image formation sequence in the exemplary embodiment 1.

FIG. 3 is a schematic timing chart illustrating an image formation sequence of the image-forming apparatus 100 according to the present exemplary embodiment. An image formation sequence of forming an image on an A4-size transfer material P is described below with reference to FIG. 3.

As illustrated in FIG. 3, first, the CPU 276 starts to apply a voltage (charging voltage) to charging rollers 2*a* to 2*d* and then performs a pretreatment operation of bringing the development rollers 42*a* to 42*d* into contact with the photosensitive drums 1*a* to 1 *d*. The time required for the pretreatment operation is approximately 1 second. Next, the CPU 276 controls the exposure control unit 277, a development power supply, the primary transfer power supply 23, and the like to perform an image-forming operation. The time required for the image-forming operation is approximately 1.5 seconds.

The CPU 276 controls the secondary transfer power supply 21 and the fixing device 30 to complete the formation of an image on the transfer material P. The CPU 276 performs a separation of the development rollers 42*a* to 42*d* from the photosensitive drums 1*a* to 1*d* and performs a collection operation (cleaning) of collecting residual toner from the intermediate transfer belt 10 into the waste-toner container 16*b* with the blade 16*a* for a predetermined time. After the cleaning of the intermediate transfer belt 10 is completed, the CPU 276 stops the rotation operation of the intermediate transfer belt 10. In the present exemplary embodiment, an operation from the time point at which the primary transfer of the toner images from the photosensitive drums 1*a* to 1*d* to the intermediate transfer belt 10 is completed to the time point at which the rotation operation of the intermediate transfer belt 10 is stopped is referred to as a post-treatment operation, and the time required for the post-treatment operation is referred to as a post-treatment time. As illustrated in FIG. 3, the post-treatment time in the present exemplary embodiment is approximately 3 seconds.

[Belt Cleaning Device 16]

Figure 4A:
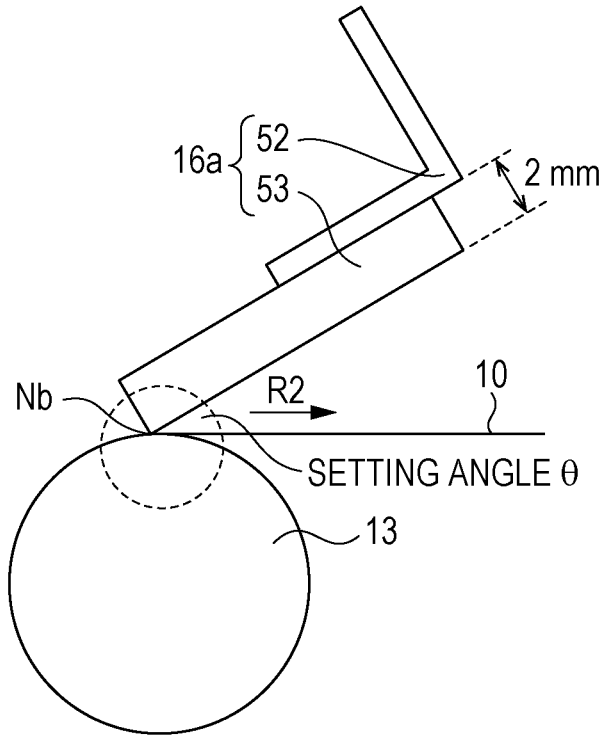
FIGS. 4A to 4C are schematic views illustrating the state of contact between a cleaning blade and an intermediate transfer belt in the exemplary embodiment 1.
Figure 4B:
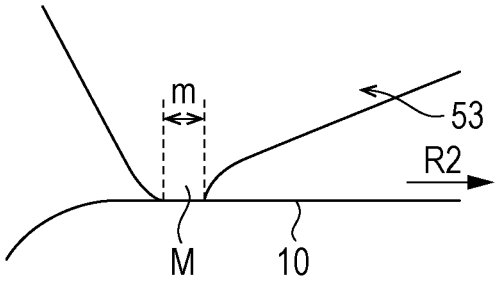

The belt cleaning device 16 is described below. FIG. 4A is a schematic view illustrating the state of contact between the blade 16*a* and the intermediate transfer belt 10. FIG. 4B is an enlarged schematic view of a contact point between the blade 16*a* and the intermediate transfer belt 10. The blade 16*a* in the present exemplary embodiment is a plate-shaped member that is long in the width direction of the intermediate transfer belt 10 (hereinafter referred to as a belt width direction), which crosses the movement direction of the intermediate transfer belt 10 (hereinafter referred to as a belt conveying direction).

The blade 16*a* in the present exemplary embodiment includes an elastic portion 53, which comes into contact with the intermediate transfer belt 10 and scrapes toner off the intermediate transfer belt 10, and a sheet metal portion 52, which supports the elastic portion 53. The elastic portion 53 is a blade member made of polyurethane. In the blade 16*a*, the elastic portion 53 that comes into contact with the intermediate transfer belt 10 has a blade shape with a width of 230 mm, and the elastic portion 53 is bonded to the sheet metal portion 52. The elastic portion 53 of the blade 16*a* has a longitudinal width of 230 mm in the belt width direction, a thickness of 2 mm, and a free length of 13 mm, which is a length from a point bonded to the sheet metal portion 52. The blade 16*a* has a hardness of 77 degrees in accordance with JIS K 6253 standard.

Facing the blade 16*a*, the opposed roller 13 is located on the inner peripheral side of the intermediate transfer belt 10. The blade 16*a* abuts against the surface of the intermediate transfer belt 10 in a direction opposite to the belt conveying direction at a position facing the opposed roller 13. Thus, the blade 16*a* abuts against the surface of the intermediate transfer belt 10 such that a free end thereof in the belt conveying direction faces upstream in the belt conveying direction. Thus, as illustrated in FIG. 4A, a blade nip portion Nb is formed between the blade 16*a* and the intermediate transfer belt 10. The blade 16*a* scrapes toner off the surface of the moving intermediate transfer belt 10 at the blade nip portion Nb and collects the toner into the waste-toner container 16*b*. In the present exemplary embodiment, the blade nip portion Nb between the blade 16*a* and the intermediate transfer belt 10 has a width of 75 μm in the belt conveying direction.

Figure 4C:
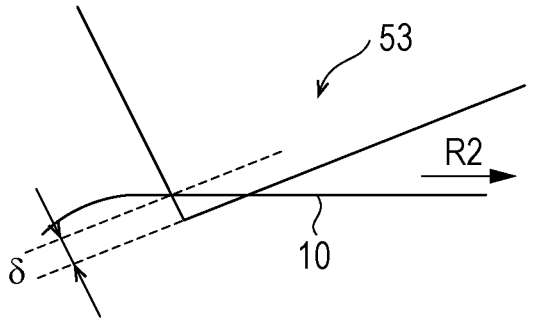

As illustrated in FIG. 4B, according to the present exemplary embodiment, the blade 16*a* is located in the counter direction, and the front edge of the blade 16*a* in contact with the intermediate transfer belt 10 receives a friction force in the belt conveying direction. The friction force exerted on the front edge of the blade 16*a* bends the front edge of the blade 16*a* in the belt conveying direction. Consequently, as illustrated in FIG. 4B, the contact portion of the blade 16*a* is curved due to the friction force at the contact portion, and the blade 16*a* is entangled with the intermediate transfer belt 10. The region in which the blade 16*a* is entangled is referred to as an entangled portion M, and the distance (length) of the entangled portion M in the belt conveying direction is referred to as an entangled amount m. As illustrated in FIG. 4C, on an imaginary line extending straight from the blade 16*a* in contact with and pushed into the intermediate transfer belt 10, the penetration depth of the blade 16*a* in the opposed roller 13 in the blade edge surface direction is referred to as an inroad amount δ.

A pressure applied from the blade 16*a* to the intermediate transfer belt 10 and concentrated in the entangled portion M can prevent toner that has reached the blade 16*a* from passing through the blade 16*a* and causing faulty cleaning.

In the present exemplary embodiment, the blade 16*a* has a setting angle θ of 22 degrees, an inroad amount δ of 1.5 mm, and a contact pressure of 20 N with respect to the intermediate transfer belt 10. The setting angle θ is an angle of the blade 16*a* (more specifically, a surface of the blade 16*a* approximately perpendicular to the thickness direction of the blade 16*a*) with respect to a tangent line of the opposed roller 13 at an intersection point between the intermediate transfer belt 10 and the blade 16*a* (more specifically, the free end of the blade 16*a*). The inroad amount δ is an overlap length in the thickness direction between the blade 16*a* and the opposed roller 13. The contact pressure is defined as a pressing force (a linear pressure in the longitudinal direction) of the blade 16*a* at the blade nip portion Nb and is measured with a film pressure measuring system (trade name: PINCH, manufactured by Nitta Corporation).

The entangled portion M of the blade 16*a* entangled by friction force between the blade 16*a* and the intermediate transfer belt 10 applies a pressure to the intermediate transfer belt 10 and thereby blocks residual toner on the intermediate transfer belt 10. The toner blocked by the blade 16*a* is then collected into the waste-toner container 16*b*. To ensure the collection of toner, therefore, the blade 16*a* abuts against the intermediate transfer belt 10 at a predetermined pressure to prevent the passing of the toner.

[Intermediate Transfer Belt]

Figure 5A:
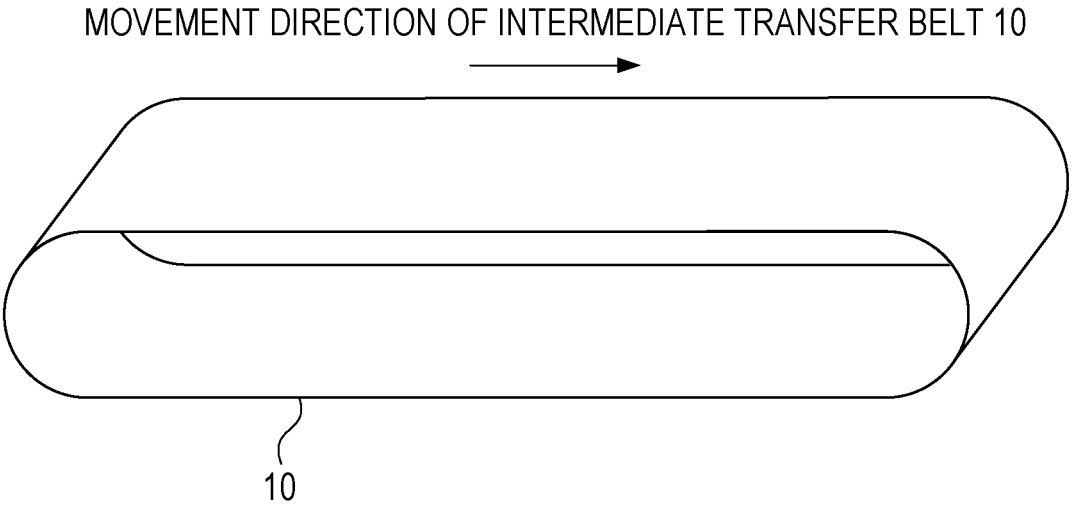
FIGS. 5A and 5B are schematic views of the intermediate transfer belt according to the exemplary embodiment 1.
Figure 5B:
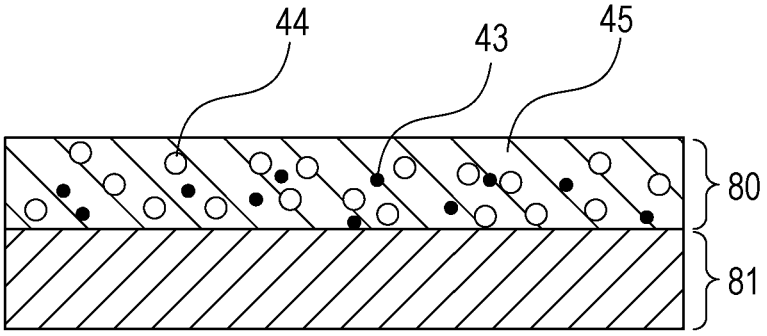

Next, the intermediate transfer belt 10 in the present exemplary embodiment is described. FIG. 5A is a schematic view of the entire structure of the intermediate transfer belt 10. FIG. 5B is a schematic enlarged partial cross-sectional view of the intermediate transfer belt 10 cut in a direction approximately perpendicular to the belt conveying direction (viewed in the belt conveying direction).

As illustrated in FIGS. 5A and 5B, the intermediate transfer belt 10 is an endless belt member (or a film member) of two layers composed of a base layer 81 and a surface layer 80. The intermediate transfer belt 10 has a circumferential length of 700 mm and a longitudinal width of 250 mm in the belt width direction. The base layer is the thickest layer of the layers constituting the intermediate transfer belt 10 in the thickness direction of the intermediate transfer belt 10. The base layer 81 in the present exemplary embodiment is a layer 70 μm in thickness in which a quaternary ammonium salt serving as an ion conductive agent is dispersed as an electrical resistance adjuster in a poly(ethylene naphthalate) resin.

The material of the base layer 81 is not limited to those described above and, in addition to the poly(ethylene naphthalate) resin, may be a thermoplastic resin, such as polycarbonate, poly(vinylidene difluoride) (PVDF), polyethylene, polypropylene, polymethylpentene-1, polystyrene, polyamide, polysulfone, polyarylate, poly(ethylene terephthalate), poly(butylene terephthalate), poly(ethylene naphthalate), poly(phenylene sulfide), polyethersulfone, polyetherenitrile, thermoplastic polyimide, poly(ether ether ketone), a thermotropic liquid crystal polymer, or poly(amic acid). Two or more of these materials may be used in combination.

The ion conductive agent added to the base layer 81 may be an ionic liquid, an electrically conductive oligomer, or a quaternary ammonium salt. One or more of these electrically conductive materials may be appropriately selected, or an electrically conductive material and an ion-conducting material may be used in combination.

The surface layer 80 is formed on the outer peripheral surface of the intermediate transfer belt 10. The surface layer 80 in the present exemplary embodiment contains a base material 45 of an acrylic resin in which antimony-doped zinc oxide is dispersed as an electrical resistance adjuster 43 and to which fluorine-containing particles, polytetrafluoroethylene (PTFE) particles, are added as a solid lubricant 44. The surface layer 80 has a thickness of 3 μm. In the present exemplary embodiment, 20 parts by weight of polytetrafluoroethylene (PTFE) particles are added to the surface layer 80.

In addition to the acrylic resin, the base material 45 of the surface layer 80 may be an organic material, such as a melamine resin, a urethane resin, an alkyd resin, a fluorinated curable resin (fluorine-containing curable resins), or another curable resin. The base material 45 may be an inorganic material, such as an alkoxysilane-alkoxyzirconium material or a silicate material. The base material 45 may be an organic-inorganic hybrid material, such as an inorganic fine particle dispersed organic polymer material, an inorganic fine particle dispersed organoalkoxysilane material, an acrylic silicon material, or an organoalkoxysilane material.

The electrical resistance adjuster 43 to be added to the surface layer 80 may also be particulate, fibrous, or flake carbon conductive filler, such as carbon black, PAN carbon fiber, or ground expanded graphite. The electrical resistance adjuster 43 may also be particulate, fibrous, or flake metallic conductive filler, such as silver, nickel, copper, zinc, aluminum, stainless steel, or iron. The electrical resistance adjuster 43 may also be particulate metal oxide conductive filler, such as zinc antimonate, antimony-doped tin oxide, antimony-doped zinc oxide, tin-doped indium oxide, or aluminum-doped zinc oxide.

From the perspective of wear resistance, crack resistance, or another strength, the surface layer 80 can be a resin material (curable resin) among curable materials and, among curable resins, can be an acrylic resin produced by curing an acrylic copolymer with an unsaturated double bond. In the present exemplary embodiment, the surface layer 80 of the intermediate transfer belt 10 is formed by applying a liquid containing an ultraviolet-curable monomer and/or oligomer component to the surface of the base layer 81 and curing the liquid by irradiation with an energy beam, such as ultraviolet light.

The intermediate transfer belt 10 in the present exemplary embodiment has a volume resistivity of $1\times10^{10}$ Ω·cm. The volume resistivity was measured with a Hiresta-UP (MCP-HT450) coupled to a UR probe (type: MCP-HTP12) both manufactured by Mitsubishi Chemical Corporation at an applied voltage of 100 V for a measurement time of 10 seconds. The environment of the measurement chamber for measuring the volume resistivity was set at a temperature of 23° C. and at a humidity of 50%. The volume resistivity of the intermediate transfer belt 10 was measured after the intermediate transfer belt 10 was left in the measurement chamber for 4 hours.

[Toner]

The toner used in the present exemplary embodiment is described below.

The toner in the present exemplary embodiment has protrusions containing an organosilicon polymer on the surface of toner particles. The protrusions are in surface contact with the surface of toner base particles. The surface contact can be rightly expected to suppress the movement, separation, and burying of the protrusions. A cross-section of the toner was observed with a scanning transmission electron microscope (STEM) to determine the degree of surface contact. FIGS. 6A to 6D are schematic views of the protrusions on the toner particles.

Figure 6A:
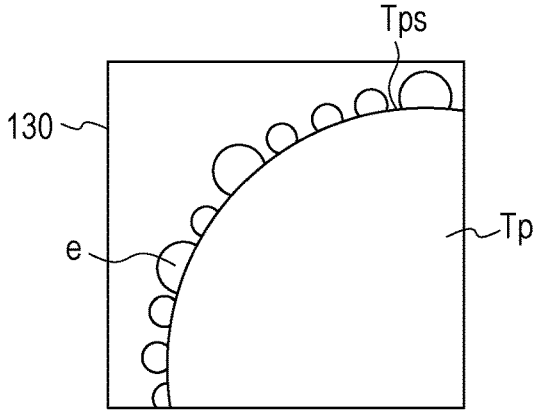
FIGS. 6A to 6D are schematic views of toner and an organosilicon polymer in the exemplary embodiment 1.

A STEM image 130 in FIG. 6A shows approximately a quarter of a cross-section of a toner particle, wherein Tp denotes a toner base particle, Tps denotes the surface of the toner base particle, and e denotes protrusions. This image illustrates a cross-section of one of four quadrants of the coordinate system having the center of the cross-section of the toner particle as the origin, and the other three quadrants should symmetrically have the same cross-section.

A cross-sectional image of the toner is observed, and a line is drawn along the circumference of the surface of the toner base particle Tp. The cross-sectional image is converted into a horizontal image on the basis of the line along the circumference. In the horizontal image, the length of a line along the circumference in a portion where a protrusion e and the toner base particle Tp form a continuous interface is defined as a protrusion width w. The maximum length of the protrusion e normal to the protrusion width w is defined as a protrusion diameter d. The length from the top of the protrusion e to the line along the circumference in the line segment forming the protrusion diameter d is defined as a protrusion height h.

The protrusion e illustrated in FIG. 6B accounts for most of protrusions formed in toner produced by a production method according to the present exemplary embodiment described later. The protrusion e has a flat portion ep and a curved portion ec, as described later.

Figure 6B:
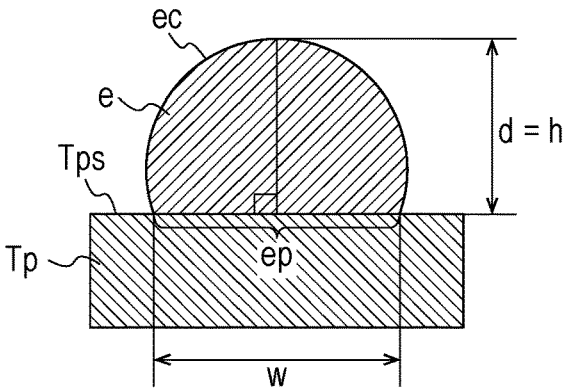
Figure 6C:
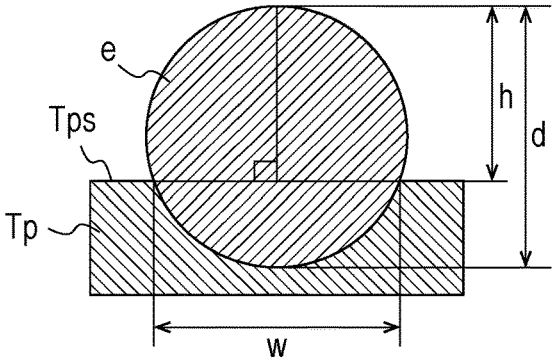
Figure 6D:
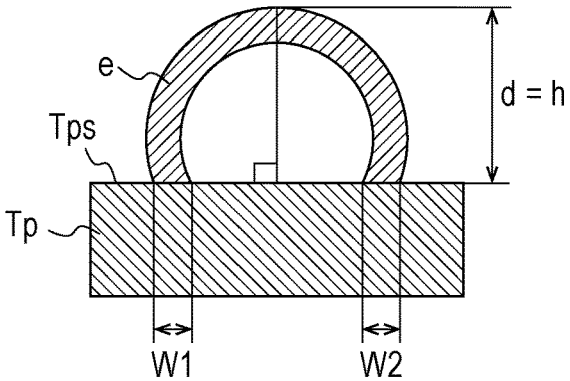

In FIGS. 6B and 6D, the protrusion diameter d is the same as the protrusion height h. In FIG. 6C, the protrusion diameter d is longer than the protrusion height h. FIG. 6D schematically illustrates the state of a fixed particle similar to a bowl-shaped particle, which is formed by breaking or dividing a hollow particle and has a hollow center. In FIG. 6D, the protrusion width w is the total length of an organosilicon compound in contact with the surface of the toner base particle. More specifically, the protrusion width w in FIG. 6D is the sum of W1 and W2.

It has been found under the above conditions that an organosilicon compound protrusion with the ratio d/w of the protrusion diameter d to the protrusion width w being 0.33 or more and 0.80 or less is rarely transferred, separated, or buried. More specifically, it has been found that when the number percentage P(d/w) of protrusions with a ratio d/w of 0.33 or more and 0.80 or less is 70% or more by number in protrusions with a protrusion height h of 40 nm or more and 300 nm or less, this results in high transferability for extended periods.

Protrusions of 40 nm or more probably produce spacer effects between the surface of toner base particles and a transfer member and improve transferability. On the other hand, protrusions of 300 nm or less probably produce significant effects of suppressing movement, separation, and burying in durability assessment.

It has been found that when the number percentage P(d/w) of protrusions of 40 nm or more and 300 nm or less is 70% or more by number, this results in a higher effect of suppressing the soiling of members while transferability is maintained for extended periods. P(d/w) is preferably 75% or more by number, more preferably 80% or more by number. The upper limit is preferably, but not limited to, 99% or less by number, more preferably 98% or less by number.

Values in the cross-sectional observation of the toner with a scanning transmission electron microscope STEM can be determined as described below wherein the width of the horizontal image (the length of a line along the circumference of the surface of a toner base particle) is defined as a perimeter L. That is, Σw/L is preferably 0.30 or more and 0.90 or less, wherein Σw denotes the sum of the protrusion widths w of protrusions with a protrusion height h of 40 nm or more and 300 nm or less among the organo silicon polymer protrusions present in the horizontal image.

Σw/L of 0.30 or more results in higher transferability and a higher effect of suppressing the soiling of members. Σw/L of 0.90 or less results in higher transferability. Σw/L is more preferably 0.45 or more and 0.80 or less.

The fixing percentage of the organosilicon polymer in the toner is preferably 80% or more by mass. At a fixing percentage of 80% or more by mass, transferability and the effect of suppressing the soiling of members can be more easily maintained in long-term use. The fixing percentage is more preferably 90% or more by mass, still more preferably 95% or more by mass. The upper limit is preferably, but not limited to, 99% or less by mass, more preferably 98% or less by mass. The fixing percentage may be controlled by the addition rate of the organosilicon compound, the reaction temperature, the reaction time, the reaction pH, and the timing of pH adjustment in the addition and polymerization of the organosilicon compound.

The protrusion height h can be determined as described below to improve transferability. In the cumulative distribution of the protrusion height h of protrusions with a protrusion height h of 40 nm or more and 300 nm or less, the protrusion height h at a cumulative number of 80% from the smallest of the protrusion height h is preferably 65 nm or more, more preferably 75 nm or more. The upper limit is preferably, but not limited to, 120 nm or less, more preferably 100 nm or less.

In the observation of the toner with a scanning electron microscope SEM, the number average diameter of the maximum protrusion diameters R of organosilicon polymer protrusions is preferably 20 nm or more and 80 nm or less, more preferably 35 nm or more and 60 nm or less. In such a range, soiling of members is less likely to occur.

The toner contains an organosilicon polymer with a structure represented by the following formula (1).

$$R—SiO_{3/2} \quad (1)$$

R denotes an alkyl group having 1 to 6 carbon atoms or a phenyl group.

In an organosilicon polymer with the structure represented by the formula (1), one of four valences of Si atoms is bonded to R and the remaining three valences are bonded to O atoms. Two valence electrons of the O atom are bonded to Si and constitute a siloxane bond (Si—O—Si). In organosilicon polymers, two Si atoms occupy three O atoms, which is represented by $—SiO_{3/2}$. The $—SiO_{3/2}$ structure of the organosilicon polymer probably has properties similar to those of silica ($SiO_2$) composed of a large number of siloxane bonds.

In the partial structure represented by the formula (1), R may be an alkyl group having 1 to 6 carbon atoms or an alkyl group having 1 to 3 carbon atoms. Examples of the alkyl group having 1 to 3 carbon atoms include, but are not limited to, a methyl group, an ethyl group, and a propyl group. R may be a methyl group.

The organosilicon polymer can be a polycondensate of an organosilicon compound with a structure represented by the following formula (Z).

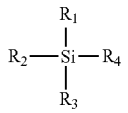

(Z)

In the formula (Z), $R_1$ denotes a hydrocarbon group (may be an alkyl group) having 1 to 6 carbon atoms, and $R_2$, $R_3$, and $R_4$ independently denote a halogen atom, a hydroxy group, an acetoxy group, or an alkoxy group.

$R_1$ can be an aliphatic hydrocarbon group having 1 to 3 carbon atoms or a methyl group.

$R_2$, $R_3$, and $R_4$ independently denote a halogen atom, a hydroxy group, an acetoxy group, or an alkoxy group (hereinafter also referred to as a reactive group). These reactive groups undergo hydrolysis, addition polymerization, or condensation polymerization and form a cross-linked structure. An alkoxy group having 1 to 3 carbon atoms, such as a methoxy group or an ethoxy group, can be used in consideration of mild hydrolysis at room temperature and precipitation on the surface of toner base particles.

Hydrolysis, addition polymerization, or condensation polymerization of $R_2$, $R_3$, and $R_4$ can be controlled via the reaction temperature, reaction time, reaction solvent, and pH. To produce an organosilicon polymer for use in the present disclosure, one or a combination of organosilicon compounds having three reactive groups ($R_2$, $R_3$, and $R_4$) except $R_1$ in a molecule in the formula (Z) (hereinafter also referred to as a trifunctional silane) may be used.

An organosilicon polymer produced by using an organosilicon compound with the structure represented by the formula (Z) in combination with the following compound may be used, provided that the advantages of the present disclosure are not significantly reduced: an organosilicon compound having four reactive groups per molecule (tetrafunctional silane), an organosilicon compound having two reactive groups per molecule (bifunctional silane), or an organosilicon compound having one reactive group per molecule (monofunctional silane).

The organosilicon polymer content of the toner particles preferably ranges from 1.0% or more by mass and 10.0% or less by mass.

The above specific protrusions may be formed on the surface of toner particles by dispersing toner base particles in an aqueous medium to prepare a toner base particle dispersion liquid and adding an organosilicon compound to the toner base particle dispersion liquid to form the protrusions, thereby preparing a toner-particle dispersion liquid.

The toner base particle dispersion liquid is preferably adjusted to have a solid content of 25% or more by mass and 50% or less by mass. The temperature of the toner base particle dispersion liquid is preferably adjusted to 35° C. or more. The pH of the toner base particle dispersion liquid can be adjusted such that the organosilicon compound is less likely to condense. The pH at which the organosilicon compound is less likely to condense depends on the substance and is preferably within ±0.5 with respect to the pH at which the organosilicon compound is least likely to condense.

The organosilicon compound can be hydrolyzed before use. For example, the organosilicon compound is hydrolyzed in a separate container in a pretreatment. Preferably 40 parts by mass or more and 500 parts by mass or less, more preferably 100 parts by mass or more and 400 parts by mass or less, of water from which ions are removed, such as ion-exchanged water or RO water, per 100 parts by mass of the organosilicon compound is used for hydrolysis. The hydrolysis conditions preferably include a pH range of 2 to 7, a temperature range of 15° C. to 80° C., and a time range of 30 to 600 minutes.

The resulting hydrolysate and the toner base particle dispersion liquid are mixed and adjusted to a pH suitable for condensation (preferably 6 to 12 or 1 to 3, more preferably 8 to 12). The protrusions are easily formed by adjusting the amount of hydrolysate such that the amount of the organosilicon compound is 5.0 parts by mass or more and 30.0 parts by mass or less per 100 parts by mass of the toner base particles. The formation of the protrusions by condensation is preferably performed in the temperature range of 35° C. to 99° C. for 60 minutes to 72 hours.

The pH can be adjusted in two steps to control the protrusion shape on the surface of the toner particles. The protrusion shape on the surface of the toner particles can be controlled by appropriately adjusting the holding time before adjusting the pH, appropriately adjusting the holding time before adjusting the pH in the second step, and condensing the organosilicon compound. For example, holding in the pH range of 4.0 to 6.0 for 0.5 to 1.5 hours and then in the pH range of 8.0 to 11.0 for 3.0 to 5.0 hours is preferred. The protrusion shape can also be controlled by adjusting the condensation temperature of the organosilicon compound in the range of 35° C. to 80° C.

For example, the protrusion width w can be controlled by the addition amount of the organosilicon compound, the reaction temperature, and the reaction pH and the reaction time in the first step. For example, the protrusion width tends to increase with the reaction time in the first step.

The protrusion diameter d and the protrusion height h can also be controlled by the addition amount of the organosilicon polymer, the reaction temperature, and the pH in the second step. For example, the protrusion diameter d and the protrusion height h tend to increase with the reaction pH in the second step.

A specific method for producing toner is described below, but the present disclosure is not limited thereto. Toner base particles can be produced in an aqueous medium, and protrusions containing an organosilicon polymer can be formed on the surface of the toner base particles.

Toner base particles can be produced by a suspension polymerization method, a dissolution suspension method, or an emulsion aggregation method, particularly the suspension polymerization method. In the suspension polymerization method, the organosilicon polymer tends to be uniformly deposited on the surface of the toner base particles, the organosilicon polymer has high adhesiveness, and the environmental stability, the effect of inhibiting a component that reverses the amount of electrical charge, and the durability and stability thereof are improved. The suspension polymerization method is further described below.

The suspension polymerization method is a method for producing toner base particles by granulating a polymerizable monomer composition containing a polymerizable monomer capable of producing a binder resin and an optional additive agent, such as a colorant, in an aqueous medium and polymerizing the polymerizable monomer contained in the polymerizable monomer composition.

If necessary, a release agent and another resin may be added to the polymerizable monomer composition. After the completion of the polymerization process, the produced particles can be washed by a known method and collected by filtration. The temperature may be increased in the latter half of the polymerization process. To remove unreacted polymerizable monomers or by-products, the dispersion medium may be partly evaporated from the reaction system in the latter half of the polymerization process or after the completion of the polymerization process.

The toner base particles thus produced can be used to form organosilicon polymer protrusions by the above method.

The toner may contain a release agent. Examples of the release agent include, but are not limited to, petroleum waxes and their derivatives, such as paraffin waxes, microcrystalline waxes, and petrolatum, montan waxes and their derivatives, Fischer-Tropsch waxes and their derivatives, polyolefin waxes and their derivatives, such as polyethylene and polypropylene, natural waxes and their derivatives, such as carnauba wax and candelilla wax, higher aliphatic alcohols, fatty acids, such as stearic acid and palmitic acid, and acid amides, esters, and ketones thereof, hydrogenated castor oil and its derivatives, plant waxes, animal waxes, and silicone resins.

The derivatives include oxides, block copolymers with vinyl monomers, and graft modified products. The releasing agents may be used alone or in combination. The release agent content is preferably 2.0 parts by mass or more and 30.0 parts by mass or less per 100 parts by mass of the binder resin or a polymerizable monomer forming the binder resin.

A polymerization initiator may be used in the polymerization of the polymerizable monomer. The amount of polymerization initiator to be added preferably ranges from 0.5 to 30.0 parts by mass per 100 parts by mass of the polymerizable monomer. A polymerization initiator may be used alone, or a plurality of polymerization initiators may be used in combination.

A chain transfer agent may be used in the polymerization of the polymerizable monomer to control the molecular weight of a binder resin constituting the toner base particles. The preferred addition amount ranges from 0.001 to 15.000 parts by mass per 100 parts by mass of the polymerizable monomer.

A crosslinking agent may be used in the polymerization of the polymerizable monomer to control the molecular weight of a binder resin constituting the toner base particles. The preferred addition amount ranges from 0.001 to 15.000 parts by mass per 100 parts by mass of the polymerizable monomer.

When an aqueous medium is used in the suspension polymerization, the following dispersion stabilizers can be used for particles of the polymerizable monomer composition: tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina. The following organic dispersants may be used: poly(vinyl alcohol), gelatin, methylcellulose, methylhydroxypropylcellulose, ethylcellulose, a carboxymethylcellulose sodium salt, and starch. Commercially available nonionic, anionic, and cationic surfactants can also be used.

The toner may contain any colorant, such as a known colorant.

The colorant content preferably ranges from 3.0 to 15.0 parts by mass per 100 parts by mass of the binder resin or a polymerizable monomer capable of forming the binder resin.

A charge control agent, such as a known charge control agent, can be used in the production of toner. The amount of charge control agent to be added preferably ranges from 0.01 to 10.00 parts by mass per 100 parts by mass of the binder resin or polymerizable monomer.

The toner particles may be directly used as toner. If necessary, an organic or inorganic fine powder may be externally added to the toner particles. The organic or inorganic fine powder preferably has a particle size of one tenth or less the weight-average particle diameter of the toner particles in terms of durability when added to the toner particles.

Examples of the organic or inorganic fine powder include:

(1) flowability imparting agents: silica, alumina, titanium oxide, carbon black, and fluorocarbon, (2) abrasives: metal oxides (for example, strontium titanate, cerium oxide, alumina, magnesium oxide, and chromium oxide), nitrides (for example, silicon nitride), carbides (for example, silicon carbide), and metal salts (for example, calcium sulfate, barium sulfate, and calcium carbonate), (3) lubricants: fluoropolymer powders (for example, vinylidene fluoride and polytetrafluoroethylene) and fatty acid metal salts (for example, zinc stearate and calcium stearate), and (4) charge control particles: metal oxides (for example, tin oxide, titanium oxide, zinc oxide, silica, and alumina) and carbon black.

The organic or inorganic fine powder may be subjected to surface treatment to improve the flowability of the toner and uniformize the charging of the toner. Examples of treatment agents for hydrophobic treatment of the organic or inorganic fine powder include unmodified silicone varnishes, modified silicone varnishes, unmodified silicone oils, modified silicone oils, silane compounds, silane coupling agents, organosilicon compounds, and organotitanium compounds. These treatment agents may be used alone or in combination.

The organosilicon polymer of the present exemplary embodiment is characteristically transferred from the toner base particles when the toner is collected from the intermediate transfer belt 10 by the blade 16*a*. This is because the collected toner base particles become dense and rub against each other near the blade 16*a*, and the friction causes the organosilicon polymer to be transferred from the toner base particles.

The organosilicon polymer is characteristically soft and easily deformed. Thus, the organosilicon polymer transferred from the toner base particles can be compressed and stretched under a certain pressure. Thus, the organosilicon polymer transferred from the toner base particles near the blade 16*a* is pressed between the blade 16*a* and the intermediate transfer belt 10 and extends on the surface of the blade 16*a*.

[Adhesion of Organosilicon Polymer to Blade]

Figure 7:
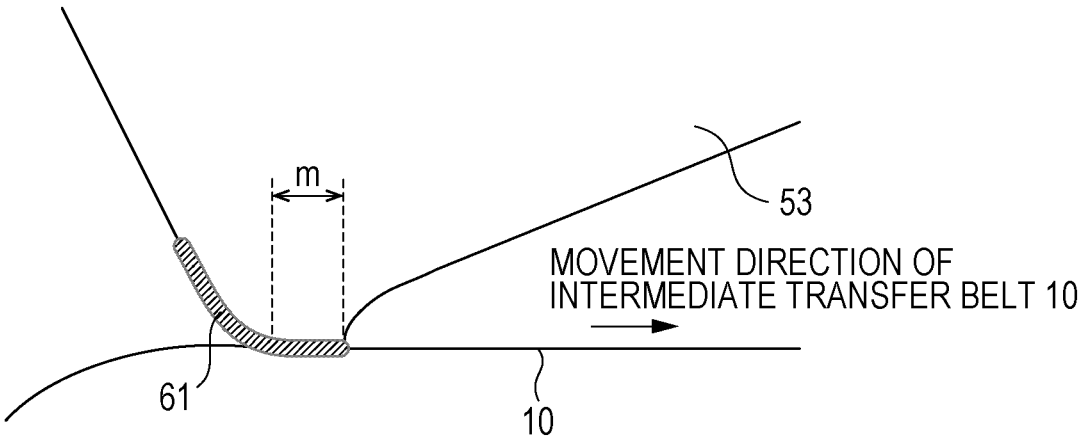
FIG. 7 is a schematic view of a coating layer formed on the cleaning blade in the exemplary embodiment 1.

FIG. 7 is a schematic view of an organosilicon polymer adhering to the blade 16*a*. The organosilicon polymer in contact with the blade 16*a* is extended due to the contact pressure on the blade 16*a*, and the extended organosilicon polymer passes through the blade nip portion Nb in a recess of an uneven surface profile of the intermediate transfer belt 10. The organosilicon polymer passing through the blade nip portion Nb adheres to the blade 16*a* in the entangled portion M. Consequently, as illustrated in FIG. 7, a coating layer 61 formed of the organosilicon polymer is formed between the blade 16*a* and the intermediate transfer belt 10. The coating layer 61 formed between the blade 16*a* and the intermediate transfer belt 10 can reduce the abrasion of the blade 16*a* due to contact with the intermediate transfer belt 10.

Figure 8:
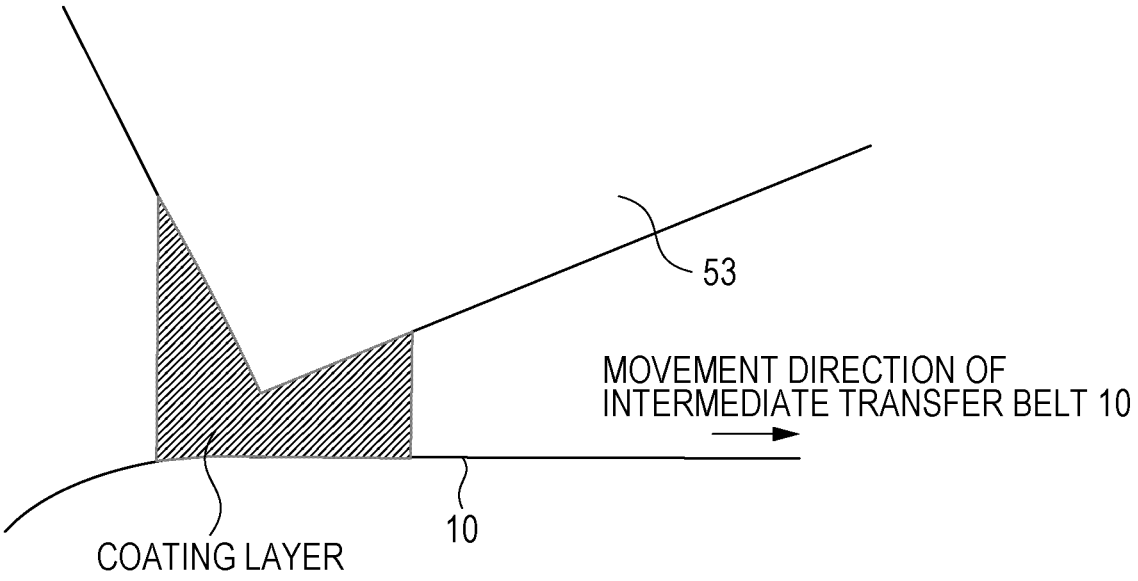
FIG. 8 is a schematic view of an excessive amount of organosilicon polymer adhering to the cleaning blade.

FIG. 8 is a schematic view of an organosilicon polymer adhering excessively to the blade 16*a*. As illustrated in FIG. 8, the organosilicon polymer adhering excessively to the blade 16*a* lifts the blade 16*a* from the intermediate transfer belt 10. In such a state, the entangled portion M is not formed at the front edge of the blade 16*a*, and the contact pressure of the blade 16*a* necessary to prevent the passing of toner cannot be generated. Consequently, toner may enter the coating layer of the organosilicon polymer between the blade 16*a* and the intermediate transfer belt 10, pass through the blade nip portion Nb, and cause faulty cleaning.

By contrast, when an excessively small amount of organosilicon polymer adheres to the blade 16*a*, the blade 16*a* may come into direct contact with the intermediate transfer belt 10, and the coating layer may not sufficiently reduce the abrasion of the blade 16*a*. Furthermore, when the blade 16*a* is continuously in direct contact with the intermediate transfer belt 10 at the blade nip portion Nb, this increases the friction force exerted on the front edge of the blade 16*a* and increases the entangled amount m of the entangled portion M of the blade 16*a*. An excessively large entangled amount m may cause the blade 16*a* abutting against the intermediate transfer belt 10 in the counter direction to be turned up toward the downstream side in the belt conveying direction.

[Adjustment of Amount of Adhesion to Blade]

The following describes adjustment control of adjusting the amount of organosilicon polymer adhering to the blade 16*a* to prevent excessive adhesion of the organosilicon polymer to the blade 16*a* and to prevent the blade 16*a* from being turned up due to insufficient adhesion.

Figure 9:
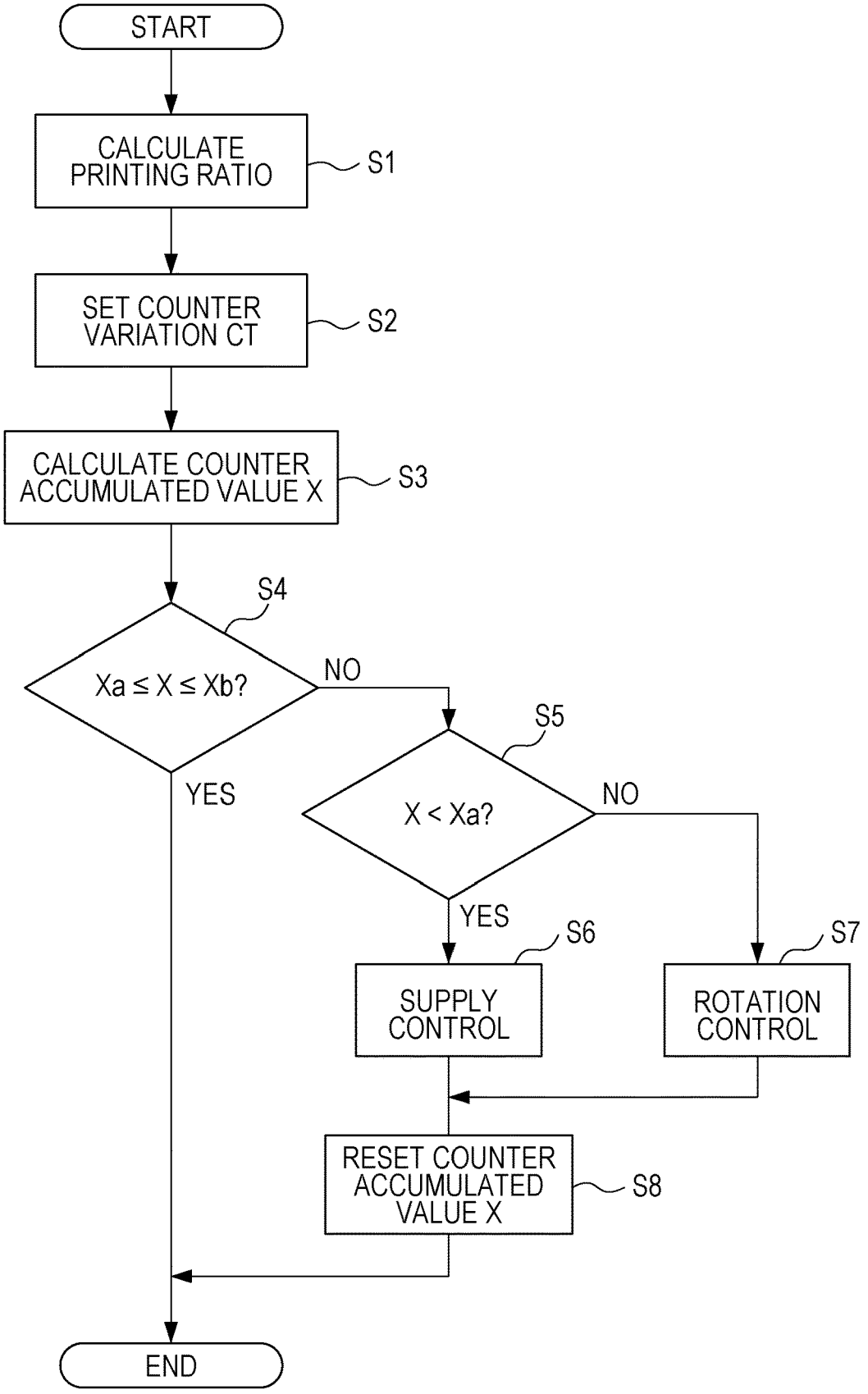
FIG. 9 is a flow chart illustrating control in the exemplary embodiment 1.

FIG. 9 is a flow chart of adjustment control of adjusting the amount of organosilicon polymer adhering to the blade 16*a*. On the basis of print job information from the personal computer 271, the CPU 276 controls a printing ratio calculation unit to calculate the printing ratios of yellow, magenta, cyan, and black of an image to be formed on one transfer material P (S1).

The CPU 276 then determines the counter variation CT (count value) for each printing ratio calculated in S1 (S2). The term "printing ratio" refers to the ratio relative to the toner consumption amount of a solid image, which is set at 1. The solid image in the present exemplary embodiment is an image formed by exposure and toner development of the entire area of an LTR-size transfer material P excluding the left, right, upper, and lower margins of 5 mm. For example, when the toner consumption amount of the solid image is 0.4 g, the toner consumption amount of an image formed at a printing ratio of 50% is 0.2 g. Under the definition of the printing ratio, the counter variation CT corresponds to the amount of consumed toner and can be considered as an amount corresponding to the amount of organosilicon polymer reaching the blade 16*a*. The setting of the counter variation CT in the present exemplary embodiment is described later.

The toner consumption amount of the solid image may vary with the durability of a developing device. The amount of toner transferred from the intermediate transfer belt 10 to the transfer material P may vary with the type of the transfer material P and the operating environment of the image-forming apparatus 100. The amount of organosilicon polymer reaching the blade 16*a* can be corrected in consideration of these effects and then reflected in the counter variation CT.

The amount of organosilicon polymer in the toner may depend on the type of toner, such as yellow, magenta, cyan, or black. The counter variation CT corresponds to the amount of organosilicon polymer reaching the blade 16*a*. Thus, for different amounts of organosilicon polymer in different types of toner, the counter variation CT can be determined for the printing ratio in each type of toner.

The CPU 276 then totals the counter variations CT determined in S2 to calculate the counter accumulated value X (S3). As described above, the counter variation CT represents the amount of organosilicon polymer reaching the blade 16*a*. Thus, the counter accumulated value X corresponds to the total amount of organosilicon polymer reaching the blade 16*a*.

The CPU 276 then determines whether the counter accumulated value X is equal to or greater than a predetermined first threshold Xa and equal to or less than a predetermined second threshold Xb (S4). If the condition is satisfied (YES), the CPU 276 ends the adjustment control without performing the control to add or remove the organosilicon polymer. If the condition is not satisfied (NO), the process proceeds to S5.

In S5, the CPU 276 determines whether the counter accumulated value X is less than the first threshold Xa. If the counter accumulated value X is less than the first threshold Xa (YES), the CPU 276 judges that the amount of organosilicon polymer to adhere to the blade 16*a* is insufficient, and the process proceeds to S6. In S6, supply control of supplying toner to the blade nip portion Nb is performed to supply the organosilicon polymer to the blade nip portion Nb. On the other hand, if the counter accumulated value X is not less than the first threshold Xa then the counter accumulated value X is greater than the second threshold Xb (NO), the CPU 276 judges that the organosilicon polymer adheres excessively to the blade 16*a*. In S7, rotation control of rotating the intermediate transfer belt 10 for a predetermined time or more is performed to decrease the amount of organosilicon polymer adhering to the blade 16*a*. After the control of S6 or S7 is completed, the CPU 276 resets the counter accumulated value X in S8 and ends the adjustment control.

<Setting of Counter Variation CT>

Figure 10:
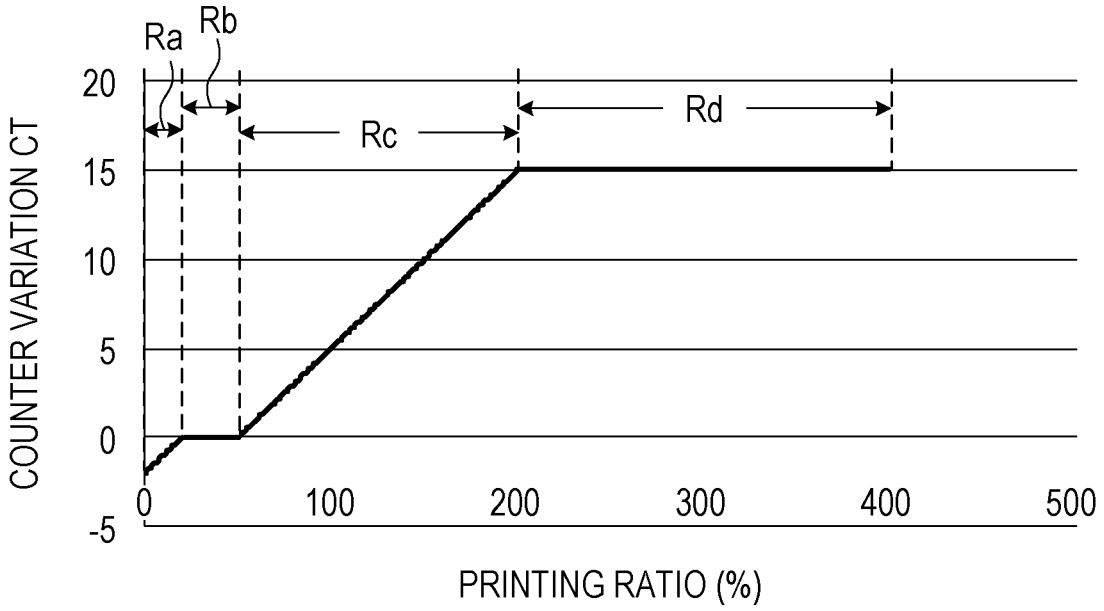
FIG. 10 is a schematic graph showing the relationship between the printing ratio and the counter variation in the exemplary embodiment 1.

FIG. 10 is a schematic graph showing the relationship between the printing ratio and the counter variation CT. In FIG. 10, the printing ratio is divided into four sections Ra, Rb, Rc, and Rd to define the relationship between the printing ratio and the counter variation CT. In the following description, the printing ratio is denoted by Pd.

The section Ra in FIG. 10 is a section of 0%<printing ratio Pd≤20%, in which a small amount of organosilicon polymer adheres to the blade 16*a* and in which the blade 16*a* may be worn away or turned up. Continuous image formation at the printing ratio Pd in this section probably results in the counter accumulated value X less than the first threshold Xa. The section Ra in the image-forming apparatus 100 according to the present exemplary embodiment is defined as 0%<printing ratio Pd≤20% by experiment. In the present exemplary embodiment, the printing ratio Pd is the total of the printing ratios of the image-forming portions a to d.

In the section Ra, the counter variation CT is calculated using the following formula 3.

$$CT=0.1\times Pd-2 \quad (3)$$

In the present exemplary embodiment, the first threshold Xa is set at −1500. Thus, for example, after an image with a printing ratio Pd of 5% is formed on 1,000 sheets of the transfer material P, the supply control of supplying the organosilicon polymer is performed.

The section Rb in FIG. 10 is a section of 20%<printing ratio Pd≤50%, in which an appropriate amount of organosilicon polymer adheres to the blade 16*a* and in which the blade 16*a* can have high durability and cleaning performance without the supply control or rotation control. The section Rb in the image-forming apparatus 100 according to the present exemplary embodiment is defined as 20%<printing ratio Pd≤50% by experiment.

In the section Rb, the counter variation CT is set at 0. Thus, for an image with a printing ratio Pd in the section Rb, the counter is not changed.

The section Rc in FIG. 10 is a section of 50%<printing ratio Pd≤200%, in which a large amount of organosilicon polymer may adhere to the blade 16*a*, the blade 16*a* may be lifted due to excessive formation of the coating layer, and the entangled portion M may be released. Continuous image formation at the printing ratio Pd in this section probably results in the counter accumulated value X greater than the second threshold Xb. The section Rc in the image-forming apparatus 100 according to the present exemplary embodiment is defined as 50%<printing ratio Pd≤200% by experiment.

In the section Rc, the counter variation CT is calculated using the following formula 4.

$$CT=0.1\times Pd-5 \quad (4)$$

In the present exemplary embodiment, the second threshold Xb is set at 1500. Thus, for example, after an image with a printing ratio Pd of 200% is formed on 100 sheets of the transfer material P, rotation control is performed to decrease the amount of organosilicon polymer at the blade nip portion Nb.

The section Rd is a section of 200%<printing ratio Pd, in which as in the section Rc an excessive amount of organosilicon polymer may adhere to the blade 16*a*, lift the blade 16*a*, and release the entangled portion M. Continuous image formation at the printing ratio Pd in this section results in the counter accumulated value X greater than the second threshold Xb and requires rotation control. The section Rc in the image-forming apparatus 100 according to the present exemplary embodiment is defined as 200%<printing ratio Pd by experiment.

[Supply Control]

The following describes the supply control of supplying toner to the blade nip portion Nb to supply the organosilicon polymer to the blade nip portion Nb. In the present exemplary embodiment, the supply control is performed in a post-treatment operation after a toner image for the final transfer material P is transferred to the intermediate transfer belt 10 in the print job at the time point when the counter accumulated value X reaches −1500.

Figure 11:
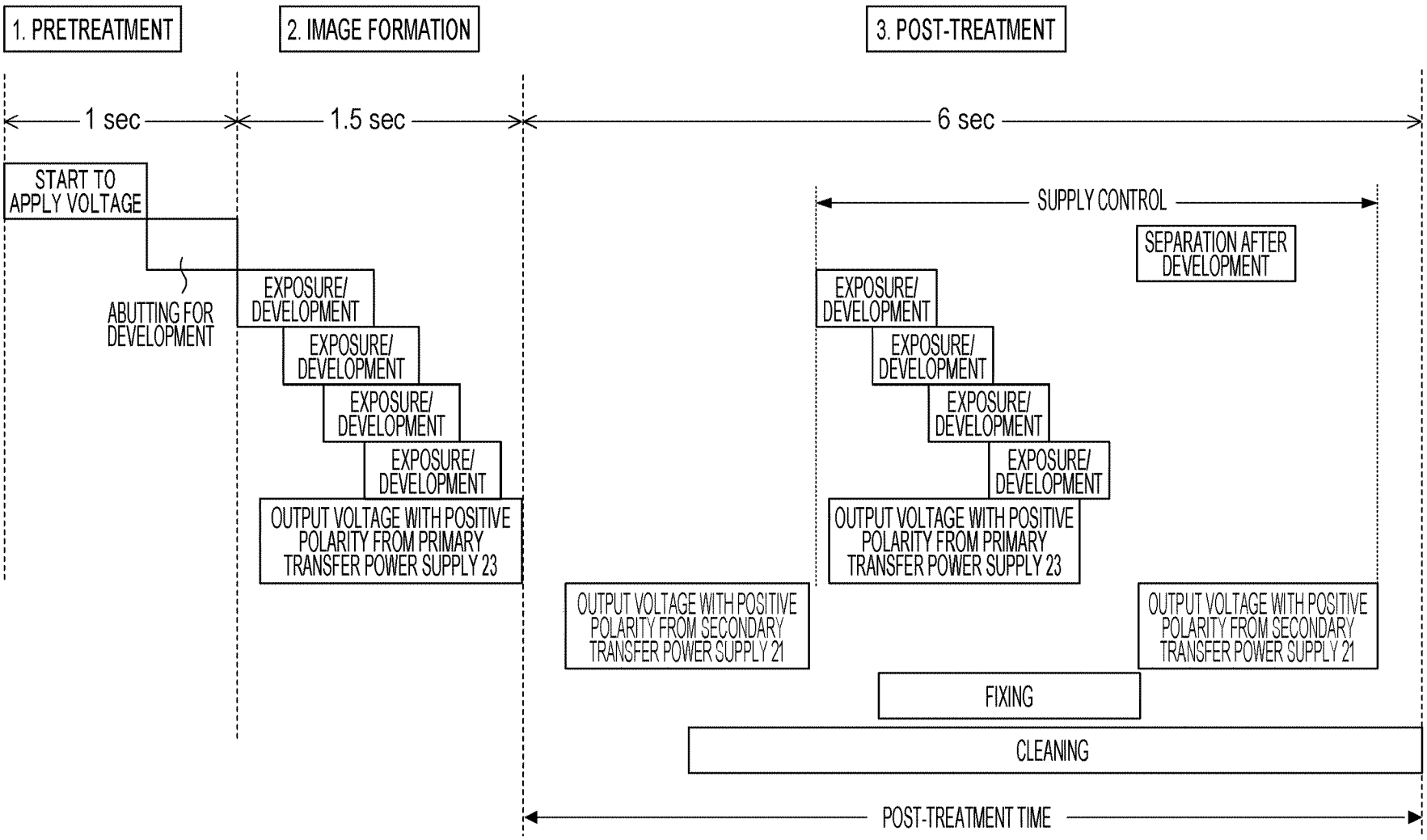
FIG. 11 is a timing chart illustrating an image formation sequence when supply control is performed in the exemplary embodiment 1.

FIG. 11 is a timing chart illustrating an image formation sequence when the supply control is performed. As illustrated in FIG. 11, when the supply control is performed, even if the final image of the print job is developed, the development rollers 42*a* to 42*d* are kept in contact with the photosensitive drums 1*a* to 1*d*. Thus, the development rollers 42*a* to 42*d* are not separated from the photosensitive drums 1*a* to 1*d*.

In the present exemplary embodiment, after the secondary transfer of the final print image (the period during which a voltage with positive polarity is output from the secondary transfer power supply 21 in FIG. 11) is completed, a toner image for supplying the organosilicon polymer to the blade nip portion Nb is formed in the image-forming portions a to d. In the present exemplary embodiment, the toner image for supplying the organosilicon polymer to the blade nip portion Nb (hereinafter referred to as a supply toner image) is a belt-like toner image 10 mm in length in the belt conveying direction formed over the entire image forming region in the belt width direction. The belt-like supply toner image is formed in the image-forming portions a to d and is formed by adjusting the development timing such that the supply toner images formed in the image-forming portions a to d do not overlap on the intermediate transfer belt 10. Upon completion of development of the supply toner images in the image-forming portions a to d, the development rollers 42*a* to 42*d* are separated from the photosensitive drums 1*a* to 1*d*.

Although the supply toner images are formed in the four image-forming portions a to d in the present exemplary embodiment, the present disclosure is not limited thereto. The supply toner image may be formed in any one of the image-forming portions or in two or three selected image-forming portions. The length of the supply toner image in the belt conveying direction and the region of the supply toner image formed in the belt width direction are not limited to those of the present exemplary embodiment, provided that a sufficient amount of organosilicon polymer can be supplied to the blade nip portion Nb. For example, the supply toner images may be formed in a plurality of image-forming portions so as not to overlap in the belt width direction. This can decrease the amount of consumed toner as compared with the case where the supply toner image is formed over the entire image forming region in a plurality of image-forming portions.

As illustrated in FIG. 11, when the supply toner image passes through the secondary transfer roller 20, a voltage with the same polarity as the charge polarity of the toner is output from the secondary transfer power supply 21 to the secondary transfer roller 20. This can prevent the supply toner image primarily transferred onto the intermediate transfer belt 10 from adhering to the secondary transfer roller 20 and can supply the supply toner image to the blade nip portion Nb.

When the supply toner image reaches the blade nip portion Nb, the organosilicon polymer formed on the surface of the toner is transferred to the blade 16*a* or the intermediate transfer belt 10 due to friction between the toner and the blade 16*a* or the intermediate transfer belt 10 or between toner particles. In the supply control, when the supply toner images formed in the image-forming portions a to d reach the blade nip portion Nb, the rotation drive of the intermediate transfer belt 10 is stopped to complete the sequence. In the present exemplary embodiment, the post-treatment operation including the supply control takes 6 seconds to complete.

In the case where the rotation drive of the intermediate transfer belt 10 is stopped when the supply toner image reaches the blade nip portion Nb as in the sequence described in the present exemplary embodiment, the organosilicon polymer in the supply toner image may be incompletely transferred. Thus, the organosilicon polymer may be partly transferred. In the next print job, however, another rotation drive of the intermediate transfer belt 10 transfers the organosilicon polymer again at the blade nip portion Nb.

The first threshold Xa may be increased to more than −1500 to decrease the frequency of the supply control. In such a case, it is desirable to increase the amount of transferred organosilicon polymer close to the maximum amount during the post-treatment operation and supply a sufficient amount of organosilicon polymer to the blade 16*a*. Thus, in such a case, in view of the transfer time of the organosilicon polymer, the execution time of the post-treatment operation may be increased to extend the rotation distance of the intermediate transfer belt 10.

[Rotation Control]

The following describes the rotation control for the rotation drive of the intermediate transfer belt 10, which increases the rotation time of the intermediate transfer belt 10 in the post-treatment operation and thereby decreases the amount of organosilicon polymer adhering to the blade 16*a*. In the present exemplary embodiment, the rotation control is performed in the post-treatment operation after a toner image for the final transfer material P is transferred to the intermediate transfer belt 10 in the print job at the time point when the counter accumulated value X reaches 1500.

Figure 12:
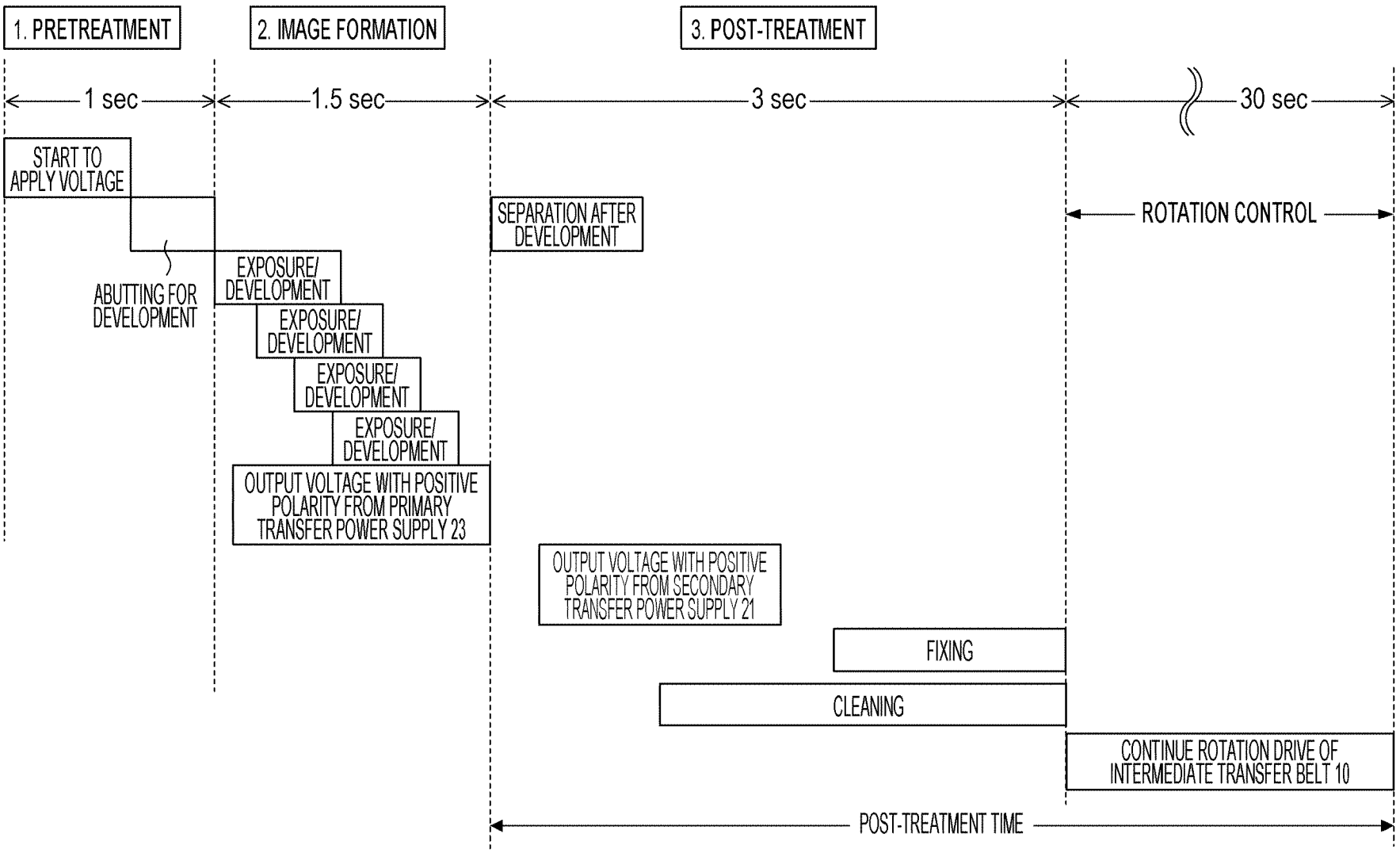
FIG. 12 is a timing chart illustrating an image formation sequence when rotation control is performed in the exemplary embodiment 1.

FIG. 12 is a timing chart illustrating the image formation sequence when the rotation control is performed. As illustrated in FIG. 12, in the rotation control, the development rollers 42*a* to 42*d* are separated from the photosensitive drums 1*a* to 1*d* when the final image of the print job is developed, as in the post-treatment operation illustrated in FIG. 3. Although the rotation operation of the intermediate transfer belt 10 is stopped upon completion of cleaning of the intermediate transfer belt 10 in the normal post-treatment operation illustrated in FIG. 3, the intermediate transfer belt 10 in the rotation control is continuously rotated for a predetermined time even after completion of the cleaning. Thus, when the counter accumulated value X is more than 1500 and the rotation control is performed, the CPU 276 performs the rotation drive of the intermediate transfer belt 10 such that the rotation time of the intermediate transfer belt 10 is longer than the post-treatment time without the rotation control (illustrated in FIG. 3).

In the present exemplary embodiment, the rotation control of continuously rotating the intermediate transfer belt 10 for 30 seconds after completion of the cleaning is performed to remove the organosilicon polymer adhering to the blade 16*a* by friction between the rotating intermediate transfer belt 10 and the blade 16*a*. Toner having the possibility of transferring the organosilicon polymer from toner base particles at the blade nip portion Nb after passing through the secondary transfer portion is hereinafter referred to as a lubricant toner. Toner passing through the secondary transfer portion in which the organosilicon polymer has been transferred from toner base particles at the blade nip portion Nb is referred to as a post-transfer toner.

Figure 13A:
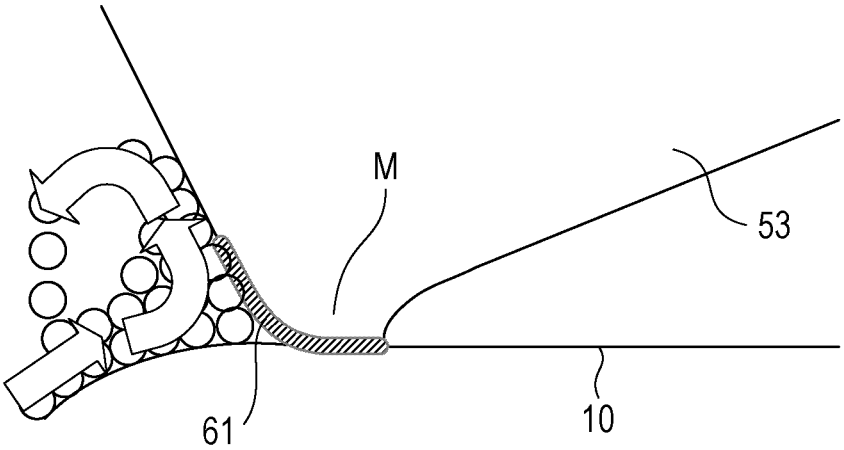
FIGS. 13A and 13B are schematic views illustrating the behavior of toner reaching the cleaning blade in the exemplary embodiment 1.

FIG. 13A is a schematic view illustrating the lubricant toner reaching the contact surface between the blade 16*a* and the intermediate transfer belt 10 in the intermediate transfer belt 10. When the lubricant toner collides with the blade 16*a*, the toner near the blade nip portion Nb behaves as illustrated in FIG. 13A due to reactions caused by collisions with the blade 16*a* and due to subsequent collisions with the lubricant toner. Thus, as indicated by the arrow in FIG. 13A, the toner is transferred upstream of the blade 16*a* in the belt conveying direction.

The organosilicon polymer on the surface of the toner base particles of the lubricant toner is transferred from the surface of the toner base particles due to collisions between toner particles or friction with the blade 16*a* and forms the coating layer 61 between the blade 16*a* and the intermediate transfer belt 10, as described above. As indicated by the arrow in FIG. 13A, the lubricant toner is transferred upward in the gravitational direction, falls due to gravity, is conveyed again on the intermediate transfer belt 10, reaches the blade nip portion Nb, and collides again with the blade 16*a*. While such behavior is repeated, the organosilicon polymer in the lubricant toner is transferred from the surface of the toner base particles, and the amount of transferred organosilicon polymer is finally decreased to zero. Thus, the lubricant toner becomes the post-transfer toner.

Thus, the amount of transferred organosilicon polymer and the transfer speed of the organosilicon polymer depend on the amount of organosilicon polymer formed on the toner base particles and the intensity of the formation. Thus, when toners of different colors are produced by different production methods, for example, there may be a difference in the amount of organosilicon polymer. In such a case, the threshold for each control and the execution time of each control may be appropriately changed with the amount and state of formed organosilicon polymer.

Figure 13B:
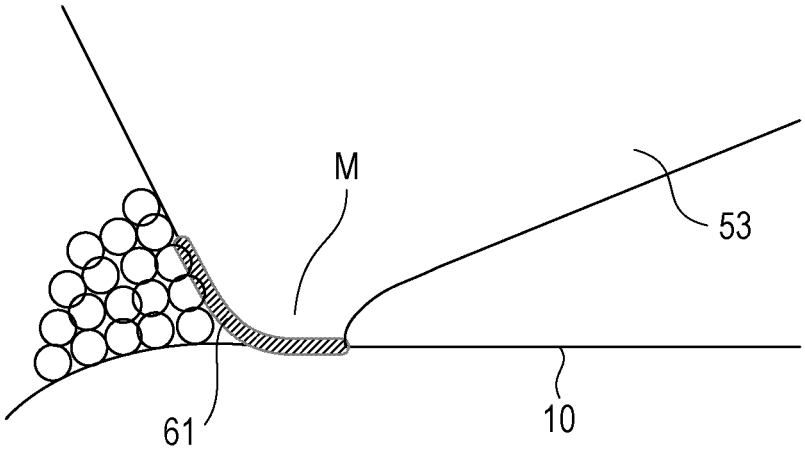

The lubricant toner reaching the blade nip portion Nb along with the movement of the intermediate transfer belt 10 is transferred by the blade 16*a* to the waste-toner container 16*b* during rotation and circulation as illustrated in FIG. 13A and reaches an equilibrium state as illustrated in FIG. 13B.

FIG. 13B is a schematic view illustrating the equilibrium state after the lubricant toner and the post-transfer toner are removed. In the equilibrium state, the lubricant toner and the post-transfer toner that are not transferred to the waste-toner container 16*b* remain near the entangled portion M of the blade 16*a*. In such a state, the organosilicon polymer is not transferred from the lubricant toner. Thus, the rotation drive of the intermediate transfer belt 10 can cause friction between the blade 16*a* and the intermediate transfer belt 10 at the blade nip portion Nb and decrease the amount of organosilicon polymer adhering to the blade 16*a*.

[Operational Advantages]

Next, the operational advantages of the supply control and the rotation control in the present exemplary embodiment are described. Evaluation results of Experiments 1 to 5 and Comparative Experiments 1 to 4 are summarized in Table 1 to verify the advantages of the present exemplary embodiment. In evaluation experiments, two-sheet intermittent image formation was performed on the transfer material P at printing ratios listed in Table 1. The cleaning performance was evaluated in different cumulative numbers of image formation sheets in the presence or absence of the supply control and the rotation control or at different frequencies of the supply control and the rotation control. In Table 1, "O" indicates no faulty cleaning, and "x" indicates faulty cleaning.

In the evaluation experiments, two-sheet intermittent image formation was performed on the transfer material P, and the transfer material P was checked for faulty cleaning after printing on 25,000 sheets, 50,000 sheets, 75,000 sheets, and 100,000 sheets. In the two-sheet intermittent image formation, continuous image formation and post-treatment operation are performed on two sheets of the transfer material P, and then the pretreatment operation is performed before another continuous image formation on two sheets of the transfer material P. Thus, it can be said that the print job of image formation on two sheets of the transfer material P is continuously performed.

In the evaluation experiments, the evaluation was completed when it was concluded that faulty cleaning occurred. After the evaluation, the blade was separated from the intermediate transfer belt, and the abrasion loss of the blade and the amount of adhered coating layer were measured. For experiments without faulty cleaning even after the two-sheet intermittent image formation was performed on 100,000 sheets of the transfer material P, the abrasion loss of the blade 16*a* and the amount of the coating layer 61 adhered were measured after the evaluation experiment of 100,000 sheets of the transfer material P.

Figure 14A:
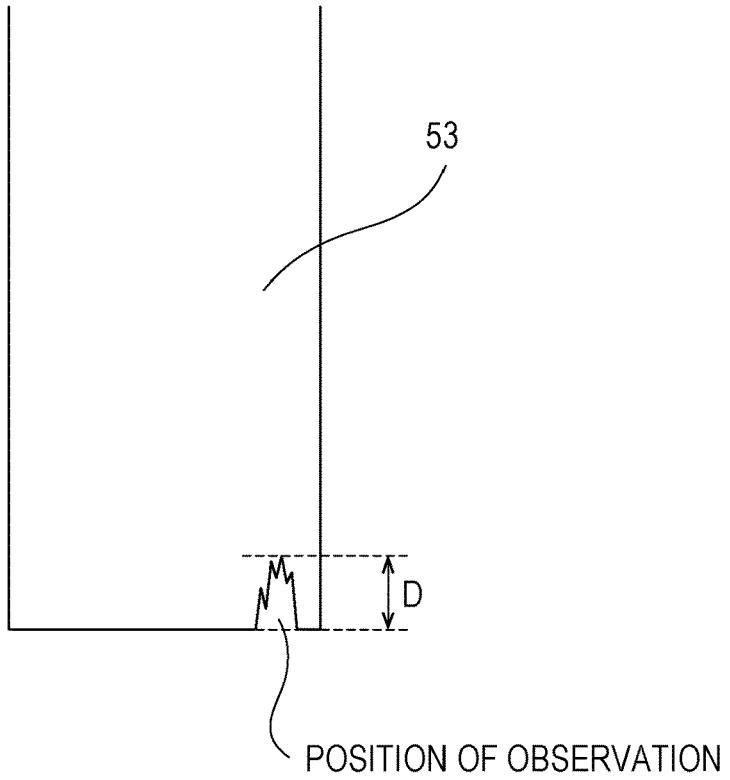
FIGS. 14A and 14B are schematic views illustrating the measurement of the abrasion loss of the cleaning blade and the amount of adhered coating layer.

FIG. 14A is a schematic view illustrating the definition of the abrasion loss of a blade. As described with reference to FIG. 4B, the front edge of the blade 16*a* is drawn by the friction force between the blade 16*a* and the intermediate transfer belt 10 and forms the entangled portion M. In the evaluation study in the present exemplary embodiment, the depth D illustrated in FIG. 14A was measured and was defined as the abrasion loss of the blade.

Figure 14B:
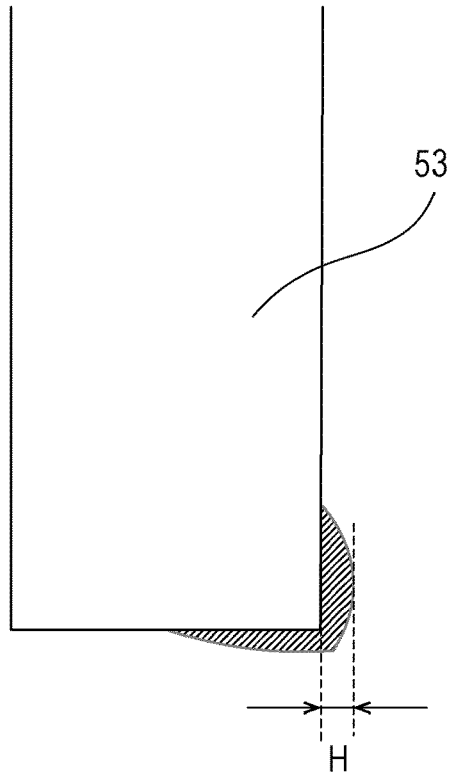

FIG. 14B is a schematic view illustrating the definition of the amount of adhered coating layer. As described with reference to FIG. 8, an excessive amount of organosilicon polymer adhering to the blade releases the entangled portion M at the front edge of the blade. In the evaluation study in the present exemplary embodiment, the height H illustrated in FIG. 14B was measured and was defined as the amount of adhered coating layer.

TABLE 1

| | Printing ratio | Performed control | 25000 sheets | 50000 sheets | 75000 sheets | 100000 sheets | Abrasion loss | Adhesion amount |
|---|---|---|---|---|---|---|---|---|
| Experiment 1 | 1% | First control/ 790 sheets | ○ | ○ | ○ | ○ | 0 μm | 2 μm |
| Experiment 2 | 5% | First control/ 1000 sheets | ○ | ○ | ○ | ○ | 0 μm | 3 μm |
| Experiment 3 | 25% | None | ○ | ○ | ○ | ○ | 0 μm | 6 μm |
| Experiment 4 | 75% | Second control/ 600 sheets | ○ | ○ | ○ | ○ | 0 μm | 5 μm |
| Experiment 5 | 100% | Second control/ 300 sheets | ○ | ○ | ○ | ○ | 0 μm | 5 μm |
| Comparative experiment 1 | 1% | None | × (turned up) | | | | — | — |

TABLE 1-continued

| | Printing ratio | Performed control | 25000 sheets | 50000 sheets | 75000 sheets | 100000 sheets | Abrasion loss | Adhesion amount |
|---|---|---|---|---|---|---|---|---|
| Comparative experiment 2 | 5% | None | ○ | ○ | × (Abrasion) | | 6 μm | 0 μm |
| Comparative experiment 3 | 75% | None | ○ | ○ | × | | 0 μm | 12 μm |
| Comparative experiment 4 | 100% | None | × | | | | 0 μm | 13 μm |

Table 1 shows that an image with a printing ratio of 1% is formed in Experiment 1. In this case, presumably due to a small supply of the organosilicon polymer to the blade 16*a*, on the basis of the formula 3 and the first threshold Xa (−1500 in this case), the supply control was performed once every time image formation was performed on 790 sheets of the transfer material P. In Experiment 1, faulty cleaning was not observed even after the image formation was performed on 100,000 sheets of the transfer material P. Observation of the blade 16*a* after the image formation on 100,000 sheets of the transfer material P showed that the height H of the coating layer 61 adhered was 2 μm, and the blade 16*a* was not worn away.

In Comparative Experiment 1 in which an image was formed at a printing ratio of 1% in the same manner as in Experiment 1, supply control was not performed even once. In Comparative Experiment 1, when an image was formed on 25,000 sheets of the transfer material P, the blade was turned up, and faulty cleaning was observed. In Comparative Experiment 1, the evaluation was ended at this point.

Next, in Experiment 2, an image was formed at a printing ratio of 5%. In this case, presumably due to a small supply of the organosilicon polymer to the blade 16*a*, on the basis of the formula 3 and the first threshold Xa (−1500 in this case), the supply control was performed once every time image formation was performed on 1,000 sheets of the transfer material P. In Experiment 2, faulty cleaning was not observed even after the image formation was performed on 100,000 sheets of the transfer material P. Observation of the blade 16*a* after the image formation on 100,000 sheets of the transfer material P showed that the height H of the coating layer 61 adhered was 3 μm, and the blade 16*a* was not worn away.

In Comparative Experiment 2 in which an image was formed at a printing ratio of 5% in the same manner as in Experiment 2, supply control was not performed even once. In Comparative Experiment 2, faulty cleaning was observed when an image was formed on 75,000 sheets of the transfer material P. Observation of the blade at the point in time when the faulty cleaning occurred showed that the depth D, which is the abrasion loss of the blade, was 6 μm, and no coating layer adhered to the blade.

In Experiment 3, an image was formed at a printing ratio of 25%. In this case, the supply of the organosilicon polymer to the blade 16*a* was assumed to be appropriate, and neither the supply control nor the rotation control was performed on the basis of the graph of FIG. 10. The evaluation results of Experiment 3 showed that faulty cleaning was not observed even after the image formation was performed on 100,000 sheets of the transfer material P. Observation of the blade 16*a* after the image formation on 100,000 sheets of the transfer material P showed that the height H of the coating layer 61 adhered was 6 μm.

In Experiment 4, an image was formed at a printing ratio of 75%. In this case, presumably due to an excessive supply of the organosilicon polymer to the blade 16*a*, on the basis of the formula 4 and the second threshold Xb (1500 in this case), the rotation control was performed once every time image formation was performed on 600 sheets of the transfer material P. In Experiment 4, faulty cleaning was not observed even after the image formation was performed on 100,000 sheets of the transfer material P. Observation of the blade 16*a* after the image formation on 100,000 sheets of the transfer material P showed that the height H of the coating layer 61 adhered was 5 μm, and the blade 16*a* was not worn away.

In Comparative Experiment 3 in which an image was formed at a printing ratio of 75% in the same manner as in Experiment 4, rotation control was not performed even once. In Comparative Experiment 3, faulty cleaning was observed when an image was formed on 75,000 sheets of the transfer material P. Observation of the blade at the point in time when the faulty cleaning occurred showed that the height H of adhered coating layer was 12 μm, and the blade was not worn away.

Next, in Experiment 5, an image was formed at a printing ratio of 100%. In this case, presumably due to an excessive supply of the organosilicon polymer to the blade 16*a*, on the basis of the formula 4 and the second threshold Xb (1500 in this case), the rotation control was performed once every time image formation was performed on 300 sheets of the transfer material P. In Experiment 5, faulty cleaning was not observed even after the image formation was performed on 100,000 sheets of the transfer material P. Observation of the blade 16*a* after the image formation on 100,000 sheets of the transfer material P showed that the height H of the coating layer 61 adhered was 5 μm, and the blade 16*a* was not worn away.

In Comparative Experiment 4 in which an image was formed at a printing ratio of 100% in the same manner as in Experiment 5, rotation control was not performed even once. In Comparative Experiment 4, faulty cleaning was observed when an image was formed on 25000 sheets of the transfer material P. Observation of the blade at the point in time when the faulty cleaning occurred showed that the height H of adhered coating layer was 13 μm, and the blade was not worn away.

These evaluation results show that no faulty cleaning occurred when the adhesion to the blade 16*a* was 6 μm or less in the present exemplary embodiment. This is probably because sufficient formation of the entangled portion M could exert a contact pressure between the blade 16*a* and the intermediate transfer belt 10 while the organosilicon polymer adhered to the blade 16*a* and formed the coating layer 61. This can reduce the abrasion of the blade 16*a*, improve durability, and reduce the occurrence of faulty cleaning.

As described above, in the present exemplary embodiment, when an image is formed at a low printing ratio and when the organosilicon polymer is insufficiently supplied to the blade nip portion Nb, the supply control is performed to supply the organosilicon polymer and reduce the occurrence of faulty cleaning. In the present exemplary embodiment, when an image is formed at a high printing ratio and when the organosilicon polymer remains excessively at the blade nip portion Nb, the rotation control is performed. This decreases the amount of organosilicon polymer at the blade nip portion Nb, removes the excessive organosilicon polymer, and reduces the occurrence of faulty cleaning. The present exemplary embodiment can reduce the occurrence of faulty cleaning while the coating layer 61 is formed. In other words, the present exemplary embodiment can reduce the occurrence of faulty cleaning while improving the durability of the blade 16*a*.

Although the supply control is performed in the post-treatment operation in the present exemplary embodiment, the present disclosure is not limited to this embodiment. In addition to the post-treatment operation, for example, at a predetermined timing during image formation, it is possible to extend the sheet interval, which is the interval of the continuously conveyed transfer material P in the conveying direction, and perform the supply control at the sheet interval. When the formatter 273 receives an image signal of the next print job, it is also possible to perform the supply control in the pretreatment operation of the print job.

Furthermore, in the present exemplary embodiment, after the cleaning of the intermediate transfer belt 10 is completed in the post-treatment operation, the rotation drive of the intermediate transfer belt 10 is performed for 30 seconds as the rotation control to remove the excessive organosilicon polymer. However, the present disclosure is not limited to this embodiment. Operation of rotating the intermediate transfer belt 10 and operation of stopping the intermediate transfer belt 10 may be alternately performed multiple times in the rotation control to remove the excessive organosilicon polymer. In such a case, static friction occurs between the blade 16*a* and the intermediate transfer belt 10 at the time of stopping the intermediate transfer belt 10. The stop operation of the intermediate transfer belt 10 vibrates the front edge of the blade 16*a* and can efficiently remove the excessive adhered organosilicon polymer.

Exemplary Embodiment 2

In the exemplary embodiment 1, the counter variation CT is determined from the printing ratio calculated from the entire image region, and the necessity of the supply control or the rotation control is determined on the basis of the counter accumulated value X, which is the cumulative value of the counter variation CT. The exemplary embodiment 2 is different from the exemplary embodiment 1 in that the image region is divided and the necessity of the supply control or the rotation control is determined on the basis of the counter accumulated value X obtained on the basis of the printing ratio in each image region. In the following description, the components described in the exemplary embodiment 1 are denoted by the same reference numerals and letters and are not described again.

For an image on the transfer material P, a toner image may be differently formed in image regions. More specifically, a toner image with a high printing ratio may be formed in one region, and a toner image with a low printing ratio may be formed in another region. In such a case, a region in which an increased amount of the coating layer 61 formed of the organosilicon polymer is adhered and a region in which a decreased amount of the coating layer 61 is adhered may coexist in the width direction of the blade 16*a*.

In view of such a situation, in the exemplary embodiment 2, the image region is divided in the width direction of the blade 16*a*, and the necessity of the supply control or the rotation control described in the exemplary embodiment 1 is determined in each image region. The width direction of the blade 16*a* refers to the width direction of the intermediate transfer belt 10 perpendicular to the belt conveying direction, refers to the direction of the rotational axis of the photosensitive drum 1, refers to the main scanning direction when the photosensitive drum 1 is exposed to light from the exposure unit 3, and refers to the direction perpendicular to the conveying direction of the transfer material P.

Figure 15:
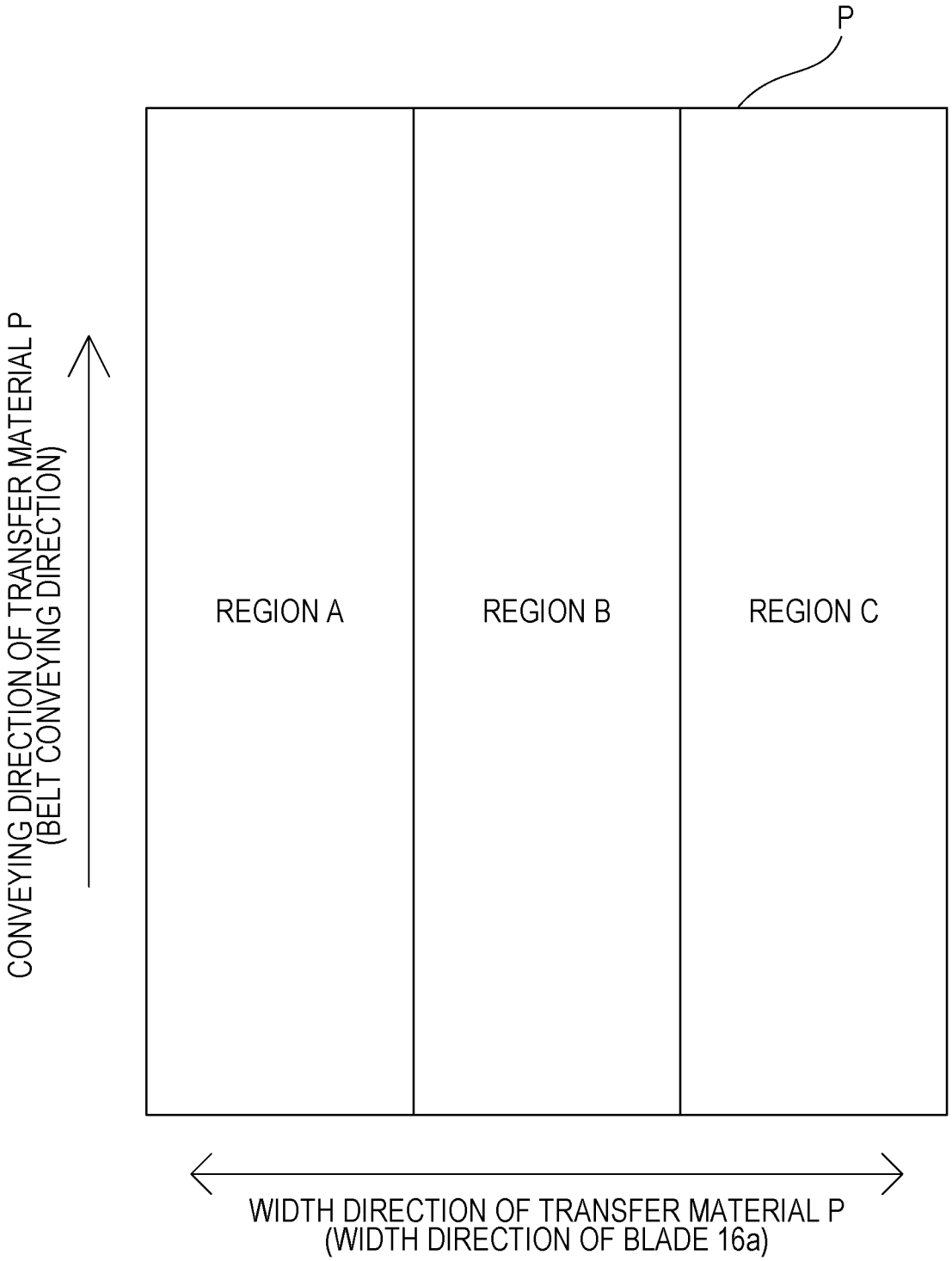
FIG. 15 is a schematic view of divided regions for calculation of the counter variation in exemplary embodiment 2.

FIG. 15 is a schematic view of the image forming region of the transfer material P divided into three regions. In the present exemplary embodiment, in each region (regions A, B, and C) in FIG. 15, the printing ratio is calculated, the counter variation CT is set, and the counter accumulated value X is calculated. Although the image forming region is divided into, for example, three regions in the present exemplary embodiment, the number of divided regions may be appropriately determined. An increased number of divided regions in the image region enables accurate control but may make the control complicated.

In the present exemplary embodiment, the counter variation CT in each region is determined on the basis of the graph of FIG. 10 and using the formula 3 or 4, as in the exemplary embodiment 1. The first threshold Xa and the second threshold Xb for the supply control or the rotation control and the control flow in each region are the same as those in the exemplary embodiment 1.

In the present exemplary embodiment, the necessity of the supply control or the rotation control is determined in each divided region, and the timing to perform the supply control in one region may overlap the timing to perform the rotation control in another region in some type of image to be formed. In such a case, the supply control and the rotation control are performed in parallel in these regions.

Figure 16:
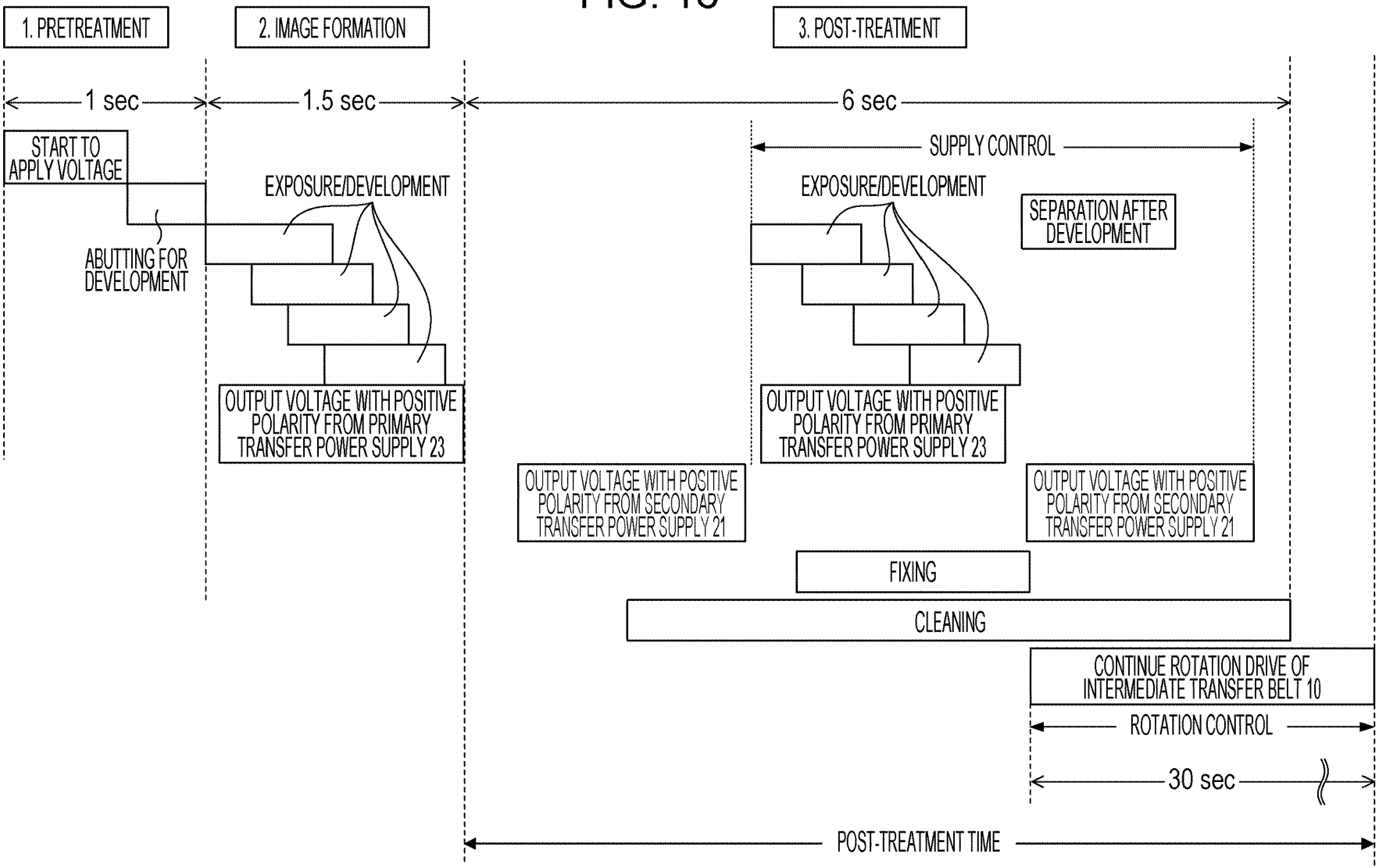
FIG. 16 is a timing chart illustrating an image formation sequence when supply control and rotation control are performed in the exemplary embodiment 2.

FIG. 16 is a timing chart illustrating an image formation sequence in which the supply control and the rotation control are performed in parallel in different regions. For example, in FIG. 16, the supply control is performed in the region A, and the rotation control is performed in the region C. In the supply control in FIG. 16, only on the image regions of the photosensitive drums 1*a* to 1*d* corresponding to the region A, the development operation is performed, and the primary transfer of a supply toner image is performed from the photosensitive drums 1*a* to 1*d* to the intermediate transfer belt 10. The supply toner image passes through the secondary transfer portion and reaches the blade nip portion Nb, and the organosilicon polymer is supplied only to the region corresponding to the region A in the width direction of the blade 16*a*.

The rotation control is performed in parallel with this operation. More specifically, the rotational drive of the intermediate transfer belt 10 is not stopped for 30 seconds after the end of fixing operation. The intermediate transfer belt 10 rotates continuously during the supply control and the cleaning operation. Thus, as illustrated in FIG. 16, the timing to perform the supply control partially overlaps the timing to perform the rotation control. Upon completion of the rotation control, the rotation drive of the intermediate transfer belt 10 is stopped.

When the supply control and the rotation control are performed in parallel in different regions as described above, the rotation control is performed in the region B even though the conditions for the supply control or the rotation control are not yet satisfied in the region B. In consideration of such a situation, the counter accumulated value X in the region B may be corrected on the assumption that image formation at a printing ratio of 0% is performed during the rotation control.

As described above, the present exemplary embodiment not only can have the same advantages as the exemplary embodiment 1 but also can perform more appropriate supply control or removal control of the organosilicon polymer for an image to be formed.

Exemplary Embodiment 3

In the exemplary embodiment 1, the counter variation CT is determined for each printing ratio, and the supply control or the rotation control is performed when the counter accumulated value X reaches the predetermined threshold. On the other hand, in the exemplary embodiment 3, the necessity of the supply control or the rotation control is determined on the basis of the rotational driving torque of the intermediate transfer belt 10, which is a parameter correlated with the amount of the coating layer 61 adhering to the blade 16*a*. In the following description, the components described in the exemplary embodiment 1 are denoted by the same reference numerals and letters and are not described again.

Table 2 shows the relationship between the amount of adhered coating layer, the friction coefficient and friction force between the intermediate transfer belt 10 and the blade 16*a*, and the rotational driving torque of the intermediate transfer belt 10.

TABLE 2

| Adhesion amount | Friction coefficient | Friction force | Rotational driving torque |
|---|---|---|---|
| 12 μm | 0.3 | 6N | 15N |
| 6 μm | 0.7 | 14N | 23N |
| 3 μm | 0.8 | 16N | 25N |

The rotational driving torque of the intermediate transfer belt 10 is the sum of the friction force generated by the blade 16*a* abutting against the intermediate transfer belt 10 and the friction force between the intermediate transfer belt 10 and three stretching rollers during the rotation of the intermediate transfer belt 10. Table 2 shows that, due to the correlation between the amount of adhered coating layer and the friction force generated by the contact of the blade 16*a*, the amount of adhered coating layer can be estimated by detecting a change in the rotational driving torque for driving the intermediate transfer belt 10.

The rotational driving torque of the intermediate transfer belt 10 can be simulated by measuring the rotational driving torque of the opposed roller 13, which receives contact pressure from the blade 16*a* and rotates the intermediate transfer belt 10. Thus, in the present exemplary embodiment, a torque detecting unit is provided to detect the rotational driving torque applied to the opposed roller 13, which faces the blade 16*a* and stretches the intermediate transfer belt 10, and the necessity of the supply control or the rotation control is determined on the basis of the detection result of the torque detecting unit.

In the present exemplary embodiment, for example, the threshold (first threshold) of the rotational driving torque to perform the supply control was set at 27 N, and the threshold (second threshold) of the rotational driving torque to perform the rotation control was set at 17 N. Thus, when the rotational driving torque of the opposed roller 13 exceeds 27 N, the organosilicon polymer is supplied by the supply control on the assumption that the amount of organosilicon polymer at the blade nip portion Nb is small. When the rotational driving torque of the opposed roller 13 is less than 17 N, the excessive organosilicon polymer is removed by the rotation control on the assumption that the amount of adhered coating layer is excessive.

Such control was performed in an evaluation experiment of two-sheet intermittent image formation in the same manner as in the exemplary embodiment 1. Even after image formation on 100,000 sheets of the transfer material P, the blade 16*a* was not turned up or worn away, and faulty cleaning was not observed. In the present exemplary embodiment, the detecting unit for detecting the rotational driving torque of the opposed roller 13 detects the driving current of a driving source (motor) for transmitting driving force to the opposed roller 13. After the detection of the driving current, the CPU 276 can determine the rotational drive torque by referring to a look-up table indicating the relationship between the driving current and the rotational drive torque stored in the memory 275 in advance.

As described above, the present exemplary embodiment can improve the durability of the blade 16*a* and reduce the occurrence of faulty cleaning. Furthermore, as in the present exemplary embodiment, the necessity of the supply control or the rotation control can be determined on the basis of the measured rotational driving torque of the opposed roller 13 to perform the control in accordance with the actual amount of the coating layer 61 adhering to the blade 16*a*.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-091673, filed May 26, 2020, which is hereby incorporated by reference herein in its entirety.

What is claimed is:

1. An image-forming apparatus comprising:

an image-bearing member configured to bear a toner image;

a developing unit, which includes a storage portion configured to accommodate toner and a developing member configured to develop a latent image formed on the image-bearing member with the toner;

a movable endless intermediate transfer member configured to be in contact with the image-bearing member, form a primary transfer portion;

a transfer member configured to be in contact with the intermediate transfer member, form a secondary transfer portion, and transfer the toner image from the intermediate transfer member to a transfer material in the secondary transfer portion;

a cleaning blade that is located downstream of the secondary transfer portion and upstream of the primary transfer portion in a movement direction of the intermediate transfer member, is in contact with the intermediate transfer member, and forms a contact portion;

a collecting portion configured to collect residual toner on the intermediate transfer member with the cleaning blade after passing through the secondary transfer portion; and a control unit configured to control execution of a supply operation of supplying the toner from the developing unit to the contact portion via the image-bearing member and via the intermediate transfer member, wherein the toner accommodated in the developing unit contains toner base particles and an organosilicon polymer on a surface of the toner base particles, and the control unit controls the supply operation to be performed when an accumulated value that correlates with an amount of the organosilicon polymer adhering to the cleaning blade is less than a first threshold.

2. The image-forming apparatus according to claim 1, wherein the accumulated value is a value obtained based on a printing ratio of an image formed on one transfer material.

3. The image-forming apparatus according to claim 2, wherein the accumulated value is a value obtained by totaling count values determined based on the printing ratio while an image-forming operation is continued.

4. The image-forming apparatus according to claim 1, wherein a post-treatment time is defined as a time during which the intermediate transfer member rotates after a toner image corresponding to a final transfer material of a print job is transferred from the image-bearing member to the intermediate transfer member until the rotation of the intermediate transfer member is stopped to terminate the print job, when the accumulated value is greater than a second threshold, the control unit controls a rotation operation of rotating the intermediate transfer member to be performed for a longer time than the post-treatment time in the case where the accumulated value is equal to or less than the second threshold, and the second threshold is greater than the first threshold.

5. The image-forming apparatus according to claim 4, wherein the control unit controls the toner image not to be transferred from the image-bearing member to the intermediate transfer member while the intermediate transfer member rotates in the rotation operation.

6. The image-forming apparatus according to claim 4, wherein the control unit alternately repeats the rotation operation and a stop operation of stopping the rotation of the intermediate transfer member and controls the toner image not to be transferred from the image-bearing member to the intermediate transfer member while the rotation operation is performed.

7. The image-forming apparatus according to claim 4, wherein the control unit controls the supply operation and the rotation operation to be suspended when the accumulated value is equal to or greater than the first threshold and equal to or less than the second threshold.

8. The image-forming apparatus according to claim 4, wherein the control unit divides an image region of one transfer material in a width direction of the transfer material perpendicular to a conveying direction of the transfer material, and controls, based on the accumulated value, determination of whether the supply operation or the rotation operation can be performed in each divided image region.

9. The image-forming apparatus according to claim 1, wherein when the control unit controls the supply operation to be performed, the control unit controls the supply operation to be performed after a toner image corresponding to an image to be formed on a final transfer material to be subjected to an image-forming operation is transferred from the image-bearing member to the intermediate transfer member, and the control unit in the supply operation controls a voltage with a polarity opposite to a normal charge polarity of the toner to be applied to the transfer member while the toner image that supplies the toner to the contact portion is transferred from the image-bearing member to the intermediate transfer member and passes through the secondary transfer portion.

10. The image-forming apparatus according to claim 1, wherein the organosilicon polymer has a structure represented by the following formula (1), wherein R denotes an alkyl group having 1 to 6 carbon atoms or a phenyl group.

11. The image-forming apparatus according to claim 1, wherein the organosilicon polymer forms protrusions on the surface of the toner base particles, and the protrusions are transferred from the surface of the toner base particles along with rotation of the intermediate transfer member at a position where the toner is collected by the cleaning blade.

12. The image-forming apparatus according to claim 1, wherein the intermediate transfer member has a surface containing an acrylic resin.

13. The image-forming apparatus according to claim 12, wherein the cleaning blade has a surface containing polyurethane.

14. An image-forming apparatus comprising:

an image-bearing member configured to bear a toner image;

a developing unit, which includes a storage portion configured to accommodate toner and a developing member configured to develop a latent image formed on the image-bearing member with the toner;

a movable endless intermediate transfer member configured to be in contact with the image-bearing member, form a primary transfer portion;

a transfer member configured to be in contact with the intermediate transfer member, form a secondary transfer portion, and transfer the toner image from the intermediate transfer member to a transfer material in the secondary transfer portion;

a cleaning blade located downstream of the transfer portion and upstream of the primary transfer portion in a movement direction of the intermediate transfer member;

a collecting portion configured to collect residual toner on the intermediate transfer member with the cleaning blade after passing through the secondary transfer portion; and a control unit configured to control a rotation operation of rotating the intermediate transfer member to be performed, wherein the toner accommodated in the developing unit contains toner base particles and an organosilicon polymer on a surface of the toner base particles, a post-treatment time is defined as a time during which the intermediate transfer member rotates after a toner image corresponding to a final transfer material of a print job is transferred from the image-bearing member to the intermediate transfer member until the rotation of the intermediate transfer member is stopped to terminate the print job, and when an accumulated value of a value correlated with an amount of the organosilicon polymer adhering to the cleaning blade is greater than a predetermined threshold, the control unit controls the rotation operation to be performed for a longer time than the post-treatment time in the case where the accumulated value is equal to or less than the predetermined threshold.

15. The image-forming apparatus according to claim 14, wherein the control unit controls the toner image not to be transferred from the image-bearing member to the intermediate transfer member in the rotation operation.

16. The image-forming apparatus according to claim 14, wherein the control unit alternately repeats the rotation operation and a stop operation of stopping the rotation of the intermediate transfer member and controls the toner image not to be transferred from the image-bearing member to the intermediate transfer member while the rotation operation is performed.

17. The image-forming apparatus according to claim 14, wherein the accumulated value is a value obtained based on a printing ratio of an image formed on one transfer material.

18. The image-forming apparatus according to claim 17, wherein the accumulated value is a value obtained by totaling count values determined based on the printing ratio while an image-forming operation is continued.

19. The image-forming apparatus according to claim 14, wherein the organosilicon polymer has a structure represented by the following formula (1), wherein R denotes an alkyl group having 1 to 6 carbon atoms or a phenyl group.

20. The image-forming apparatus according to claim 14, wherein the organosilicon polymer forms protrusions on the surface of the toner base particles, and the protrusions are transferred from the surface of the toner base particles along with rotation of the intermediate transfer member at a position where the toner is collected by the cleaning blade.

* * * * *